US011699856B1

(12) United States Patent
Hill

(10) Patent No.: US 11,699,856 B1
(45) Date of Patent: Jul. 11, 2023

(54) VEHICULAR HALF LOOP ANTENNA AND VEHICULAR ANTENNA DEVICE

(71) Applicant: HARADA INDUSTRY OF AMERICA, INC., Novi, MI (US)

(72) Inventor: Shawn Hill, Novi, MI (US)

(73) Assignee: HARADA INDUSTRY OF AMERICA, INC., Novi, MI (US)

( * ) Notice: Subject to any disclaimer, the term of this patent is extended or adjusted under 35 U.S.C. 154(b) by 0 days.

(21) Appl. No.: 17/676,069

(22) Filed: Feb. 18, 2022

(51) Int. Cl.
*H01Q 1/32* (2006.01)
*H01Q 7/00* (2006.01)
*H01Q 13/16* (2006.01)

(52) U.S. Cl.
CPC ..... *H01Q 13/16* (2013.01); *H01Q 1/32* (2013.01); *H01Q 7/00* (2013.01)

(58) Field of Classification Search
CPC .. H01Q 1/24; H01Q 1/32; H01Q 7/00; H01Q 13/16; H01Q 1/48
See application file for complete search history.

(56) References Cited

U.S. PATENT DOCUMENTS

| | | | | |
|---|---|---|---|---|
| 4,721,963 | A * | 1/1988 | Nagy | H01Q 13/16 343/714 |
| 4,868,577 | A * | 9/1989 | Wingard | H01Q 1/3275 343/713 |
| 5,285,210 | A * | 2/1994 | Sato | H01Q 7/00 343/744 |
| 9,093,750 | B2 * | 7/2015 | Thiam | H04B 7/0413 |
| 9,123,997 | B2 * | 9/2015 | Ieda | H01Q 9/40 |
| 9,270,019 | B2 | 2/2016 | Thiam et al. | |
| 10,886,621 | B2 * | 1/2021 | Tanaka | H01Q 1/36 |
| 11,264,724 | B2 * | 3/2022 | Miller | H01Q 13/18 |
| 2021/0296790 | A1 | 9/2021 | Kobayashi et al. | |

FOREIGN PATENT DOCUMENTS

WO 2020121748 A1 6/2020

* cited by examiner

*Primary Examiner* — Tho G Phan
(74) *Attorney, Agent, or Firm* — Global IP Counselors, LLP

(57) ABSTRACT

A vehicular half loop antenna is provided that includes a ground section and a feed section. The ground section has a ground point that is configured to be electrically grounded. The feed section is configured to be electrically connected to the ground section. The feed section includes a first feed portion having a feed point that is configured to be electrically connected to an antenna feed, and a second feed portion connected to the first feed portion via a corner portion therebetween, with the corner portion being located farther from the ground point than the feed point and having a curved or tapered outer edge.

20 Claims, 27 Drawing Sheets farfield (f=0.71) [1]

Frequency = 0.71 GHz
Main lobe magnitude = 0.823 dBi
Main lobe direction = 177.0 deg.
Angular width (3 dB) = 168.2 deg.
Side lobe level = -2.9 dB farfield (f=0.71) [2]

Frequency = 0.71 GHz
Main lobe magnitude = 0.779 dBi
Main lobe direction = 1.0 deg.
Angular width (3 dB) = 168.9 deg.
Side lobe level = -2.6 dB

VEHICULAR HALF LOOP ANTENNA AND VEHICULAR ANTENNA DEVICE

BACKGROUND

Field of the Invention

This invention generally relates to a vehicular half loop antenna and a vehicular antenna device.

Background Information

Generally, a low profile antenna (LPA) device is becoming popular as a vehicular antenna device that is mounted on a vehicle body of a vehicle. Such a vehicular antenna device has a structure in which multiple antennas and a circuit substrate are compactly housed interior defined by a base member and a cover member. The multiple antennas are designed to cover various frequency bands of various radio signals, such as AM/FM radio signals, television signals, GNSS (Global Navigation Satellite System) signals, ETC (Electronic Toll Collection System) signals, cellular signals, etc.

SUMMARY

When the LPA device includes MIMO (multiple-input and multiple-output) antennas for cellular signals, monopole antennas are typically utilized as cellular antennas. However, it has been discovered that these monopole antennas need to be further improved to meet bandwidth and gain requirements, especially at lower frequency bands. Furthermore, when multiple cellular antennas are utilized in the LPA device, sufficient isolation between these cellular antennas needs to be ensured.

The present disclosure is directed to various features of a vehicular antenna and a vehicular antenna device.

In view of the state of the known technology and in accordance with one aspect of the present disclosure, a vehicular half loop antenna is provided that includes a ground section and a feed section. The ground section has a ground point that is configured to be electrically grounded. The feed section is configured to be electrically connected to the ground section. The feed section includes a first feed portion having a feed point that is configured to be electrically connected to an antenna feed, and a second feed portion connected to the first feed portion via a corner portion therebetween, with the corner portion being located farther from the ground point than the feed point and having a curved or tapered outer edge.

In view of the state of the known technology and in accordance with another aspect of the present disclosure, a vehicular antenna device is provided that includes an antenna base and a pair of half loop antennas. The antenna base is configured to be attached to a vehicle body of a vehicle. The half loop antennas are disposed on the antenna base at locations spaced apart from each other in a first direction of the antenna base. The half loop antennas each includes a ground section having a ground point that is configured to be electrically grounded, and a feed section configured to be electrically connected to the ground section. The feed section includes a first feed portion having a feed point that is configured to be electrically connected to an antenna feed, and a second feed portion connected to the first feed portion via a corner portion therebetween, with the corner portion being located farther from the ground point than the feed point.

Also other objects, features, aspects and advantages of the disclosed vehicular half loop antenna and vehicular antenna device will become apparent to those skilled in the art from the following detailed description, which, taken in conjunction with the annexed drawings, discloses embodiments of the vehicular half loop antenna and vehicular antenna device.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the vehicle field from this disclosure that the following descriptions of the embodiments are provided for illustration only and not for the purpose of limiting the invention as defined by the appended claims and their equivalents.

Figure 1:
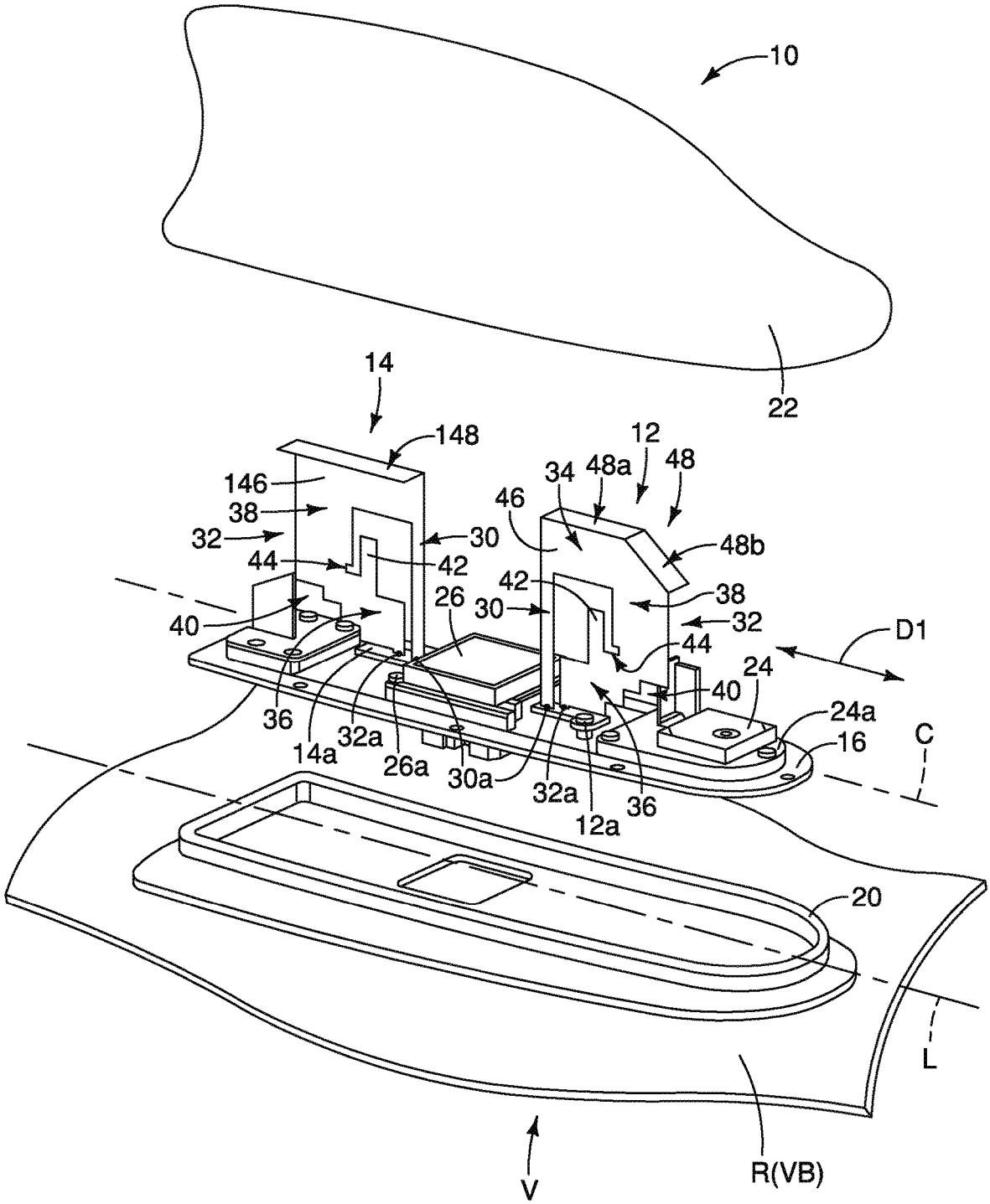
FIG. 1 is an exploded perspective view of an antenna device (e.g., a vehicular antenna device) equipped with a pair of half loop antennas (e.g., vehicular half loop antennas) in accordance with one illustrated embodiment.

Referring initially to FIG. 1, an antenna device 10 (e.g., a vehicular antenna device) 10 is illustrated that is equipped with a pair of half loop antennas 12 and 14 (e.g., vehicular half loop antennas) in accordance with a first embodiment. The antenna device 10 is an antenna device mounted on a roof R (e.g., a vehicle body) of a vehicle V. Specifically, the antenna device 10 is a streamlined antenna device which becomes thinner toward the front. The antenna device of such a shape is generally referred to as a low profile antenna (LPA) device or a shark fin antenna device. In some cases, the antenna device 10 can also be mounted on a vehicle body of the vehicle V, other than the roof R of the vehicle V, such as on a spoiler, a trunk cover, etc.

As illustrated in FIG. 1, the antenna device 10 comprises an antenna base 16 and the half loop antennas 12 and 14. In the illustrated embodiment, the antenna base 16 is configured to be attached to the roof R of the vehicle V. Specifically, the antenna base 16 is configured to be attached to the roof R of the vehicle V such that a longitudinal direction D1 (e.g., a first direction) of the antenna base 16 along a center axis C of the antenna base 16 is aligned with a longitudinal axis L of the vehicle body VB of the vehicle V. In the illustrated embodiment, the antenna base 16 is made of conductive material, such as metal. In the illustrated embodiment, the antenna base 16 includes a threaded boss 18 insertable to a hole formed on the roof R of the vehicle V. The antenna base 16 is coupled to the roof R of the vehicle V with a nut that is threadedly coupled to the threaded boss 18 to sandwich the roof R of the vehicle V between the nut and the antenna base 16. In the illustrated embodiment, a coaxial cable CB (FIG. 3) is inserted through the threaded boss 18 to electrically connect the antenna device 10 to an interior antenna module that is disposed within an interior of the vehicle V and processes signals from the antenna device 10. Thus, the coaxial cable CB serves as an antenna feed of the antenna device 10.

In the illustrated embodiment, the antenna device 10 further comprises a base pad 20. The base pad 20 is a member made of, for example, rubber, elastomer, resin, etc. In the illustrated embodiment, the base pad 20 is fixedly coupled to the antenna base 16. Specifically, the base pad 20 is integrally formed with the antenna base 16 such that an outer edge portion of the antenna base 16 is embedded by a rim portion of the base pad 20. Said differently, in the illustrated embodiment, the antenna base 16 and the base pad 20 form a composite antenna base for attaching the antenna device 10 to the vehicle V. In the illustrated embodiment, the base pad 20 directly contacts with the roof R of the vehicle V when the antenna base 16 is attached to the roof R of the vehicle V.

In the illustrated embodiment, the antenna device 10 further comprises an antenna housing or cover 22. The antenna housing 22 is a cover that is made of a radio-wave transparent synthetic resin. The antenna housing 22 is attached to the antenna base 16 to house the half loop antennas 12 and 14 within an interior space defined between the antenna base 16 and the antenna housing 22. In the illustrated embodiment, the antenna housing 22 is fixedly coupled to the antenna base 16 with screws or other fasteners. With this configuration, the half loop antennas 12 and 14 are covered by the antenna housing 22 so as not to be visible from outside.

Figure 2:
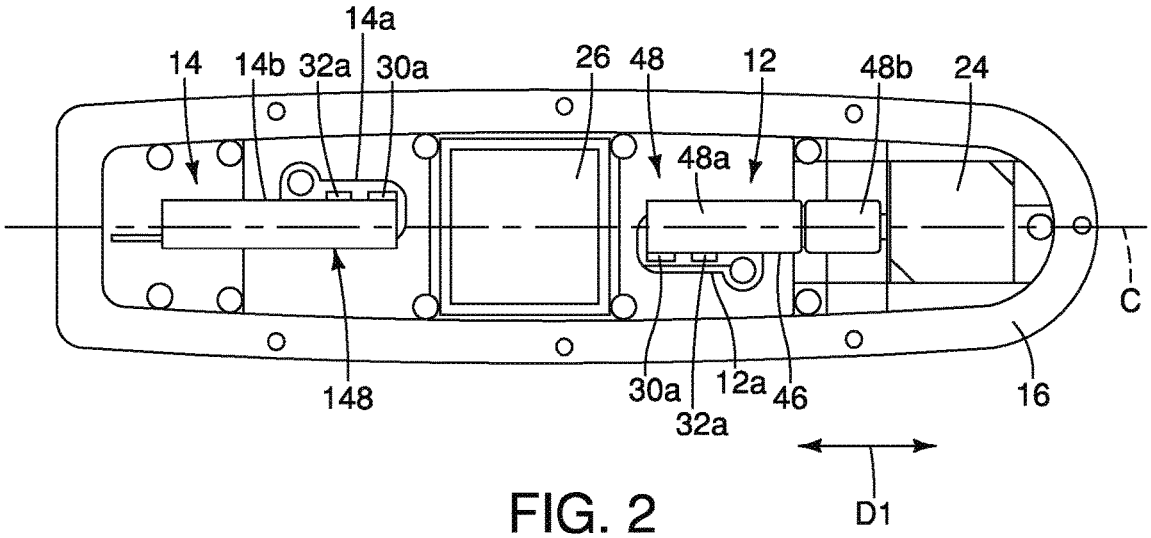
FIG. 2 is a top plan view of the antenna device illustrated in FIG. 1 in which an antenna housing being removed to show inside the antenna device.
Figure 3:
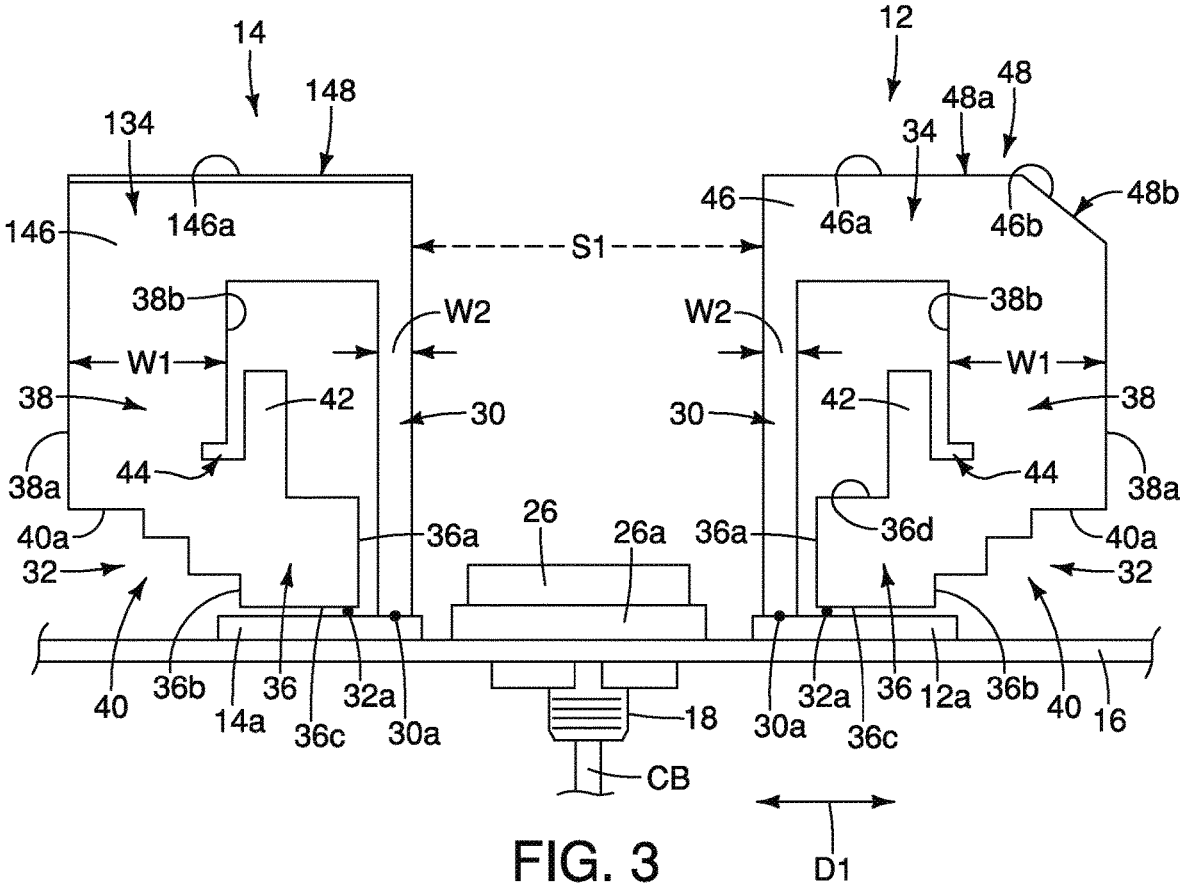
FIG. 3 is an elevational view of the antenna device illustrated in FIG. 1, illustrating the half loop antennas being disposed on an antenna base.

As illustrated in FIGS. 1 and 2, the half loop antennas 12 and 14 are disposed on the antenna base 16 at locations spaced apart from each other in the longitudinal direction D1 of the antenna base 16 along the center axis C of the antenna base 16. Specifically, the half loop antennas 12 and 14 are disposed on the antenna base 16 via circuit substrates 12*a* and 12*b*, respectively, that are electrically connected to the interior antenna module via the coaxial cable CB (FIG. 3). In the illustrated embodiment, the half loop antennas 12 and 14 are a cellular antenna. In particular, the half loop antennas 12 and 14 are dimensioned to correspond to a half-wavelength at a frequency between 0.6 GHz to 6 GHz so as to be compatible with 5G (5th Generation Mobile Communication System). However, the half loop antennas 12 and 14 can be differently dimensioned to be compatible with 3G (3rd Generation Mobile Communication System), or 4G (4th Generation Mobile Communication System) for transmitting and receiving radio waves of several hundred MHz to several GHz.

In the illustrated embodiment, the half loop antennas 12 and 14 corporately function with each other as MIMO (multiple-input and multiple-output) antennas for ensuring high-speed communication for 5G. Specifically, in the illustrated embodiment, the half loop antennas 12 and 14 are configured to transmit and receive radio waves in the same frequency band. However, the half loop antennas 12 and 14 can be configured to transmit and receive radio waves in the slightly shifted frequency bands as long as the half loop antennas 12 and 14 can corporately function as MIMO antennas. The configurations of the half loop antennas 12 and 14 will be described in detail later.

In the illustrated embodiment, the antenna device 10 further comprises additional antennas, as needed and/or desired. Specifically, as illustrated in FIGS. 1 and 2, the antenna device 10 has a plurality of (two in FIGS. 1 and 2) planar or patch antennas 24 and 26. In the illustrated embodiment, the patch antenna 24 covers a frequency band of a satellite radio signals, such as SiriusXM™, while the patch antenna 26 covers a frequency band of GNSS signals, for example. However, of course, the patch antennas 24 and 26 can cover different frequency bands of television signals or ETC signals. Furthermore, the antenna device 10 can further comprise additional antennas other than the patch antennas 24 and 26 for further covering different frequency bands for different applications, such as for AM/FM radio signals. C-V2X (Cellular Vehicle to Everything) that transmits and receives radio waves of several hundred MHz to several GHz, etc. In the illustrated embodiment, as illustrated in FIGS. 1 and 2, the patch antennas 24 and 26 are disposed on the antenna base 16 via circuit substrates 24*a* and 26*a*, respectively, that are electrically connected to the interior antenna module via the coaxial cable (FIG. 3).

As illustrated in FIGS. 1 and 2, the patch antennas 24 and 26 are disposed on the antenna base 16 at locations spaced apart from each other in the longitudinal direction D1 of the antenna base 16 along the center axis C of the antenna base 16. Specifically, in the illustrated embodiment, the patch antenna 26 is disposed on the antenna base 16 between the half loop antennas 12 and 14 in the longitudinal direction D1 of the antenna base 16.

Referring further to FIG. 3, the configurations of the half loop antennas 12 and 14 will be described in detail. As shown in FIG. 3, the half loop antenna 12 comprises a ground section 30 and a feed section 32. In the illustrated embodiment, the half loop antenna 12 further comprises an intermediate section 34. The ground section 30, the feed section 32 and the intermediate section 34 are integrated as a one-piece, unitary member. Specifically, in the illustrated embodiment, the ground section 30, the feed section 32 and the intermediate section 34 are made of metal plate. However, the ground section 30, the feed section 32 and the intermediate section 34 can be made of any other suitable conducting material, as needed and/or desired.

The ground section 30 has a ground point 30*a* that is configured to be electrically grounded. Specifically, the ground point 30*a* is electrically connected to the vehicle body VB of the vehicle V directly or via the circuit board 12*a*. The feed section 32 is configured to be electrically connected to the ground section 30. In the illustrated embodiment, the feed section 32 is configured to be electrically connected to the ground section 30 via the intermediate section 34.

The feed section 32 includes a first feed portion 36 and a second feed portion 38. The first feed portion 36 has a feed point 32*a* that is configured to be electrically connected to the coaxial cable CB (e.g., the antenna feed). Specifically, the feed point 32*a* is configured to be electrically connected to the coaxial cable CB via the circuit board 12*a*. In the illustrated embodiment, the feed point 32*a* is disposed spaced apart from the ground point 30*a* in the longitudinal direction D1 of the antenna base 16. The feed point 32*a* is electrically connected to the ground point 30*a* only via the feed section 32, the intermediate section 34 and the ground section 30.

In the illustrated embodiment, the first feed portion 36 has a first end 36*a* and a second end 36*b* that is opposite the first end 36*a* in the longitudinal direction D1 of the antenna base 16. As shown in FIG. 3, the first end 36*a* is disposed closer to the ground section 30 than the second end 36*b* in the longitudinal direction D1 of the antenna base 16. The feed point 32*a* is disposed on an outer edge 36*c* of the first feed portion 36 at a location closer to the first end 36*a* of the first feed portion 36 than the second end 36*b* of the first feed portion 36. Specifically, in the illustrated embodiment, the feed point 32*a* is disposed on the outer edge 36*c* of the first feed portion 36 at the first end 36*a* of the first feed portion 36. However, the feed point 32*a* can be disposed other locations on the outer edge 36*c* of the first feed portion 36, as needed and/or desired.

The second feed portion 38 is connected to the first feed portion 36 via a corner portion 40 therebetween. In particular, the corner portion 40 is connected to the second end 36*b* of the first feed portion 36. The corner portion 40 is located farther from the ground point 30*a* than the feed point 32*a*. Said differently, the feed point 32*a* is located between the ground point 30*a* and the corner portion 40 in the longitudinal direction D1 of the antenna base 16.

In the illustrated embodiment, the corner portion 40 has a tapered outer edge 40*a*. Specifically, as illustrated in FIG. 3, the tapered outer edge 40*a* is stepwisely tapered such that the tapered outer edge 40*a* extends from the outer edge 36*c* of the first feed portion 36 to an outer edge 38*a* of the second feed portion 38. In particular, in the illustrated embodiment, the tapered outer edge 40*a* is connected to the second end 36*b* of the first feed portion 36 and is stepwisely tapered such that the distance between the tapered outer edge 40 and an upper surface of the antenna base 16 increases as moving toward the outer edge 38*a* of the second feed portion 38.

In the illustrated embodiment, the second feed portion 38 of the feed section 32 is spaced apart from the ground section 30 in the longitudinal direction D1 of the antenna base 16. The second feed portion 38 of the feed section 32 has a width W1 in the longitudinal direction D1 that is larger than a width W2 of the ground section 30 in the longitudinal direction D1.

As shown in FIG. 3, the feed section 32 further includes an extension part 42 that faces opposite an inner edge 38*b* of the second feed portion 38 with a slot 44 therebetween. Specifically, in the illustrated embodiment, the extension part 42 is an upright extension that extends from an inner edge 36*d* of the first feed portion 36 toward the intermediate section 34. In particular, the extension part 42 extends from the inner edge 36*d* of the first feed portion 36 at a location spaced apart from the first end 36*a* of the first feed portion 36. However, the extension part 42 can extend from the inner edge 36*d* of the first feed portion 36 at the first end 36*a* of the first feed portion 36, as needed and/or desired. In the illustrated embodiment, the slot 44 has an L-shape. However, the slot 44 can have other shape, as needed and/or desired.

As illustrated in FIG. 3, the intermediate section 34 is connected between the ground section 30 and the second feed portion 38 of the feed section 32. In the illustrated embodiment, the intermediate section 34 includes a base portion 46 and a bent portion 48. The base portion 46 is connected between the ground section 30 and the second feed portion 38 of the feed section 32. The bent portion 48 is bent relative to the base portion 46. In the illustrated embodiment, the bent portion 48 is bent at a right angle relative to the base portion 46. Thus, in the illustrated embodiment, the half loop antenna 12 is entirely flat and upright member, except for the bent portion 48.

In the illustrated embodiment, the bent portion 48 includes a first bent part 48*a* and a second bent part 48*b*. The first bent part 48*a* is bent along a first edge 46*a* of the base portion 46, while the second bent part 48*b* is bent along a second edge 46*b* of the base portion 46. Specifically, as shown in FIGS. 1 and 2, the first bent part 48*a* and the second bent part 48*b* are bent leftward with respect to the base portion 46 as viewed from the rear in the longitudinal direction D1 of the antenna base 16. The first edge 46*a* and the second edge 46*b* are continuous and form an outer edge of the base portion 46. In the illustrated embodiment, the first edge 46*a* and the second edge 46*b* extend in different directions. In particular, the first edge 46*a* extends parallel to the longitudinal direction D1 of the antenna base 16, while the second edge 46*b* extends in a direction non-parallel to the longitudinal direction D1 of the antenna base 16. Specifically, the second edge 46*b* is inclined downward as moving toward the front along the longitudinal direction D1 of the antenna base 16 to conform with the outer shape of the antenna housing 22 which becomes thinner toward the front.

In the illustrated embodiment, the half loop antenna 12 forms a resonant loop antenna having a perimeter close to half-wavelength at the operating frequency. In particular, an electrical path is defined through the half loop antenna 12 between the ground point 30*a* and the feed point 32*a*. In particular, in the illustrated embodiment, the ground section 30, the feed section 32 and the intermediate section 34 are dimensioned to define the electrical path that extends between the ground point 30*a* and the feed point 32*a* and has a length corresponding to a half-wavelength at a frequency between 0.6 GHz to 6 GHz so as to be compatible with 5G. Specifically, in the illustrated embodiment, the ground section 30, the feed section 32 and the intermediate section 34 are dimensioned such that the electrical path extending between the ground point 30*a* and the feed point 32 has a length of 24 cm, for example, which corresponds to a half-wavelength at a frequency between 0.6 GHz to 6 GHz. Of course, the length of the electrical path is not limited to this, and can be different for different frequency bands. In the illustrated embodiment, since the intermediate section 34 includes the bent portion 48, the desired length of the electrical path can be achieved without making the overall height or width of the half loop antenna 12 larger. In particular, without the bent portion 48, the overall height of the half loop antenna 12 needs to be increased to achieve the desired length of the electrical path, which make it difficult to accommodate the half loop antenna 12 within the antenna housing 22. Also, without the bent portion 48, the overall width of the half loop antenna 12 in the longitudinal direction D1 needs to be increased to achieve the desired length of the electrical path, which make it difficult to make the antenna device 10 compact. In the illustrated embodiment, the bent portion 48 is bent relative to the base portion 46 by 15 mm, for example.

As shown in FIG. 3, the half loop antenna 14 is basically identical to the half loop antenna 12, except for the shape of the intermediate section 34 of the half loop antenna 12. Since the half loop antenna 14 is basically identical to the half loop antenna 12, the parts of the half loop antenna 14 that are identical to the parts of the half loop antenna 12 will be given the same reference numerals as the parts of the half loop antenna 12. Moreover, the descriptions of the parts of the half loop antenna 14 that are identical to the parts of the half loop antenna 12 may be omitted for the sake of brevity.

Specifically, the half loop antenna 14 comprises an intermediate section 134 instead of the intermediate section 34 of the half loop antenna 12. With the half loop antenna 14, the ground section 30, the feed section 32 and the intermediate section 134 are integrated as a one-piece, unitary member. Specifically, in the illustrated embodiment, the ground section 30, the feed section 32 and the intermediate section 134 are made of metal plate. However, the ground section 30, the feed section 32 and the intermediate section 134 can be made of any other suitable conducting material, as needed and/or desired. With the half loop antenna 14, the feed section 32 is configured to be electrically connected to the ground section 30 via the intermediate section 134.

With the half loop antenna 14, the intermediate section 134 is connected between the ground section 30 and the second feed portion 38 of the feed section 32. In the illustrated embodiment, the intermediate section 134 includes a base portion 146 and a bent portion 148. The base portion 146 is connected between the ground section 30 and the second feed portion 38 of the feed section 32. The bent portion 148 is bent relative to the base portion 146. In the illustrated embodiment, the bent portion 148 is bent at a right angle relative to the base portion 146. Thus, in the illustrated embodiment, the half loop antenna 14 is entirely flat and upright member, except for the bent portion 148.

In the illustrated embodiment, the bent portion 148 is bent along an outer edge 146*a* of the base portion 146. Specifically, as shown in FIGS. 1 and 2, the bent portion 148 is bent rightward with respect to the base portion 146 as viewed from the rear in the longitudinal direction D1 of the antenna base 16. The outer edge 146*a* extends parallel to the longitudinal direction D1 of the antenna base 16.

In the illustrated embodiment, the half loop antenna 14 forms a resonant loop antenna having a perimeter close to half-wavelength at the operating frequency. In particular, an electrical path is defined through the half loop antenna 14 between the ground point 30*a* and the feed point 32*a*. In particular, in the illustrated embodiment, the ground section 30, the feed section 32 and the intermediate section 134 are dimensioned to define the electrical path that extends between the ground point 30*a* and the feed point 32*a* and has a length corresponding to a half-wavelength at a frequency between 0.6 GHz to 6 GHz so as to be compatible with 5G.

As shown in FIGS. 1 to 3, the half loop antennas 12 and 14 are disposed spaced apart from each other in the longitudinal direction D1 of the antenna base 16. Specifically, in the illustrated embodiment, as seen in FIG. 3, the half loop antennas 12 and 14 are disposed spaced apart by a distance S1 that is at least one-tenth (1/10) wavelength of the fundamental frequency (f0) to increase the isolation between the half loop antennas 12 and 14 for both lower frequency band and higher frequency band. In particular, in the illustrated embodiment, the distance S1 is 48 mm to 54 mm for the fundamental frequency (f0) of 600 MHz to 617 MHz.

Furthermore, in the illustrated embodiment, the half loop antennas 12 and 14 are arranged relative to each other such that the ground sections 30 of the half loop antennas 12 and 14 face toward each other and the feed sections 32 of the half loop antennas 12 and 14 face away from each other. Furthermore, the half loop antennas 12 and 14 are arranged relative to each other such that the ground sections 30 of the half loop antennas 12 and 14 are disposed between the feed sections 32 of the half loop antennas in the longitudinal direction D1 of the antenna base 16.

As also shown in FIG. 2, the half loop antennas 12 and 14 are arranged relative to the antenna base 16 such that the ground point 30*a* and the feed point 32*a* of each of the half loop antennas 12 and 14 are aligned relative to each other along the longitudinal direction D1 of the antenna base 16. In particular, as shown in FIG. 2, the ground point 30*a* and the feed point 32*a* of the half loop antenna 12 are aligned relative to each other along the longitudinal direction D1 of the antenna base 16, while the ground point 30*a* and the feed point 32*a* of the half loop antenna 14 are aligned relative to each other along the longitudinal direction D1 of the antenna base 16.

In the illustrated embodiment, the ground point 30*a* and the feed point 32*a* of the half loop antenna 12 and the ground point 30*a* and the feed point 32*a* of the half loop antenna 14 are laterally offset relative to each other. Specifically, as shown in FIG. 2, the ground point 30*a* and the feed point 32*a* of the half loop antenna 12 are laterally offset relative to the center axis C of the antenna base 16 and are disposed on the right half of the antenna base 16. On the other hand, the ground point 30*a* and the feed point 32*a* of the half loop antenna 14 are laterally offset relative to the center axis C of the antenna base 16 and are disposed on the left half of the antenna base 16. In particular, in the illustrated embodiment, the ground point 30*a* and the feed point 32*a* of the half loop antenna 12 and the ground point 30*a* and the feed point 32*a* of the half loop antenna 14 are laterally and oppositely offset relative to the center axis C of the antenna base 16 by an offset distance of 0 mm to 5 mm, respectively. The offset distance is preferably 5 mm. With this configuration, the isolation between the half loop antennas 12 and 14 can be increased for both a lower frequency band between 0.617 GHz and 0.7 GHz and a higher frequency band between 3 GHz and 5 GHz.

In the illustrated embodiment, as seen in FIG. 2, the half loop antennas 12 and 14 are laterally arranged with respect to the center axis C of the antenna base 16 such that center axes of the bent portions 48 and 148 of the half loop antennas 12 and 14 are parallel to and laterally aligned with the center axis C of the antenna base 16. However, the half loop antennas 12 and 14 are laterally arranged in a different manner. In particular, the half loop antennas 12 and 14 can be laterally arranged with respect to the center axis C of the antenna base 16 such that the center axes of the bent portions 48 and 148 of the half loop antennas 12 and 14 are parallel to and laterally offset relative to the center axis C of the antenna base 16, or such that the center axes of the bent portions 48 and 148 of the half loop antennas 12 and 14 are non-parallel to the center axis C of the antenna base 16.

In the illustrated embodiment, as seen in FIG. 2, the half loop antennas 12 and 14 are symmetrically arranged with respect to each other. In particular, the half loop antennas 12 and 14 are arranged with respect to each other in a rotationally symmetric manner about a vertical axis that is perpendicular to the center axis C of the antenna base 16.

With each of the half loop antennas 12 and 14, a wide band loop antenna can be achieved that meets bandwidth and gain requirements, especially at lower frequency bands. In particular, with each of the half loop antennas 12 and 14, the width W1 of the second feed portion 38 of the feed section 32 is increased relative to the width W2 of the ground section 30, which can increase the bandwidth of the half loop antennas 12 and 14. Furthermore, with each of the half loop antennas 12 and 14, the feed section 32 has the tapered outer edge 40*a* away from the ground section 30, which can increase impedance match to 50 ohms for high frequencies. With each of the half loop antennas 12 and 14, the feed section 32 has the slot 44 having the L-shape, which can increase high frequency gains at low elevations. With each of the half loop antennas 12 and 14, a top portion of each of the half loop antennas 12 and 14 are folded to form the bent portions 48 and 148, which lowers the fundamental frequency by increasing electrical height of the half loop antennas 12 and 14. Furthermore, with the antenna device 10, the half loop antennas 12 and 14 are arranged relative to each other such that the ground sections 30 of the half loop antennas 12 and 14 face toward each other, which increases isolation between the half loop antennas 12 and 14 for the fundamental frequencies. Thus, MIMO antennas that ensures high-speed communication can be achieved. These effects of the present disclosure will be described in detail below.

In the illustrated embodiment, an example in accordance with one embodiment is illustrated in which the antenna device 10 includes the half loop antennas 12 and 14. However, the present invention is not limited to this, and at least one of the half loop antennas 12 and 14 can be replaced with modified half loop antennas with modified structure in accordance with alternate embodiments, as shown in FIGS. 4 to 9.

Figure 4:
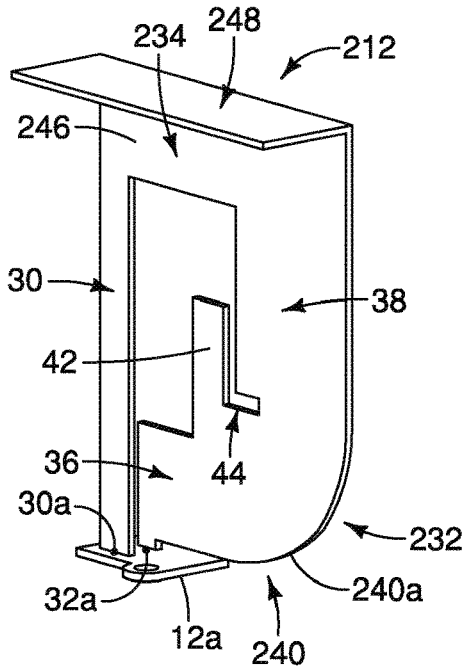
FIG. 4 is a perspective view of a half loop antenna in accordance with an alternate embodiment.
Figure 5:
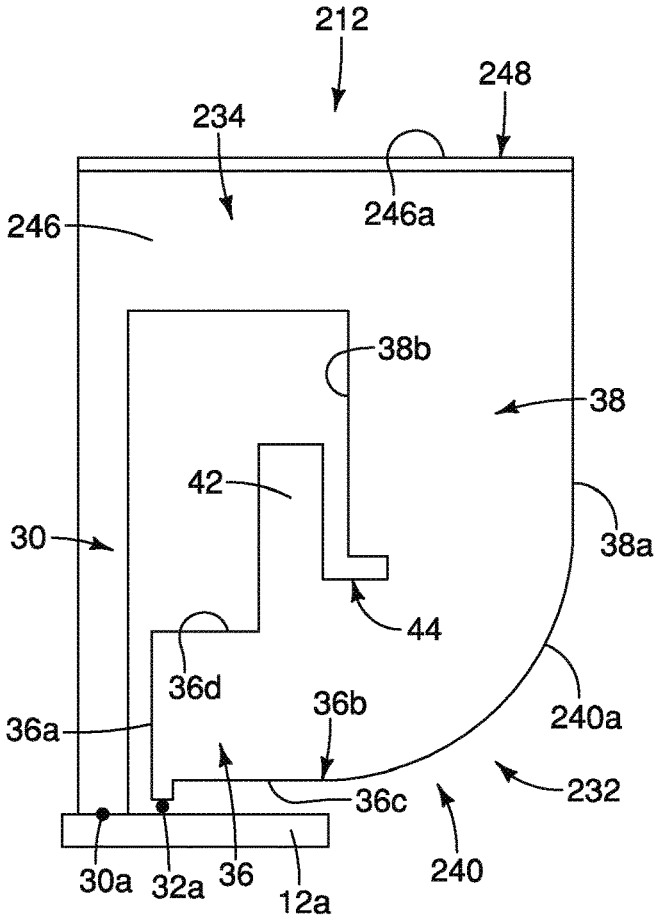
FIG. 5 is an elevational view of the half loop antenna illustrated in FIG. 4.

Specifically, in the illustrated embodiment, as seen in FIG. 3, the corner portion 40 has the tapered outer edge 40*a*. However, the corner portion 40 can have a different outer edge. Specifically, as seen in FIGS. 4 and 5, a feed section 232 of a half loop antenna 212 in accordance with an alternate embodiment can have a corner portion 240 with a curved outer edge 240*a*. Since the half loop antenna 212 is basically identical to the half loop antennas 12 and 14, the parts of the half loop antenna 212 that are identical to the parts of the half loop antennas 12 and 14 will be given the same reference numerals as the parts of the half loop antennas 12 and 14. Moreover, the descriptions of the parts of the half loop antenna 212 that are identical to the parts of the half loop antennas 12 and 14 may be omitted for the sake of brevity.

Specifically, as illustrated in FIG. 5, the curved outer edge 240*a* is curved such that the curved outer edge 240*a* extends to smoothly connect the outer edge 36*c* of the first feed portion 36 with the outer edge 38*a* of the second feed portion 38. In particular, in the illustrated embodiment, the curved outer edge 240*a* is connected to the second end 36*b* of the first feed portion 36 and is upwardly curved such that the distance between the curved outer edge 240*a* and the upper surface of the antenna base 16 increases as moving toward the outer edge 38*a* of the second feed portion 38.

As seen in FIGS. 4 and 5, the half loop antenna 212 is illustrated as including an intermediate section 234 that is similar to the intermediate section 134 of the half loop antenna 14. Specifically, in the illustrated embodiment, the intermediate section 234 includes a base portion 246 and a bent portion 248. The base portion 246 is connected between the ground section 30 and the second feed portion 38 of the feed section 232. The bent portion 248 is bent relative to the base portion 246. In the illustrated embodiment, the bent portion 248 is bent at a right angle relative to the base portion 246 along an outer edge 246*a* of the base portion 246. In particular, the bent portion 248 is bent rightward with respect to the base portion 246 as viewed from the rear in the longitudinal direction D1 of the antenna base 16. The outer edge 246*a* extends parallel to the longitudinal direction D1 of the antenna base 16. However, the bent portion 248 can be bent leftward with respect to the base portion 246 as viewed from the rear in the longitudinal direction D1 of the antenna base 16. Also, the intermediate section 234 can be similar to the intermediate section 34 of the half loop antenna 12.

Figure 6:
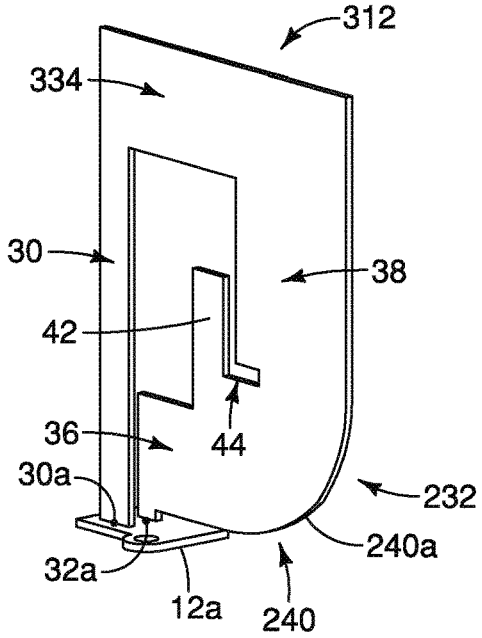
FIG. 6 is a perspective view of a half loop antenna in accordance with another alternate embodiment.

Furthermore, the half loop antenna 212 can further be modified to remove the bent portion 248. Specifically, as seen in FIG. 6, an intermediate section 334 of a half loop antenna 312 in accordance with an alternate embodiment can be configured without a bent portion. Since the half loop antenna 312 is basically identical to the half loop antenna 212, the parts of the half loop antenna 312 that are identical to the parts of the half loop antenna 212 will be given the same reference numerals as the parts of the half loop antenna 212. Moreover, the descriptions of the parts of the half loop antenna 312 that are identical to the parts of the half loop antenna 212 may be omitted for the sake of brevity.

Specifically, in the illustrated embodiment, as seen in FIG. 6, the intermediate section 334 is connected between the ground section 30 and the second feed portion 38 of the feed section 232. Thus, in the illustrated embodiment, the half loop antenna 312 is entirely flat and upright member. Furthermore, the half loop antennas 12 and 14 with the tapered outer edge 40*a* can further be similarly modified to remove the bent portions 48 and 148.

Figure 7:
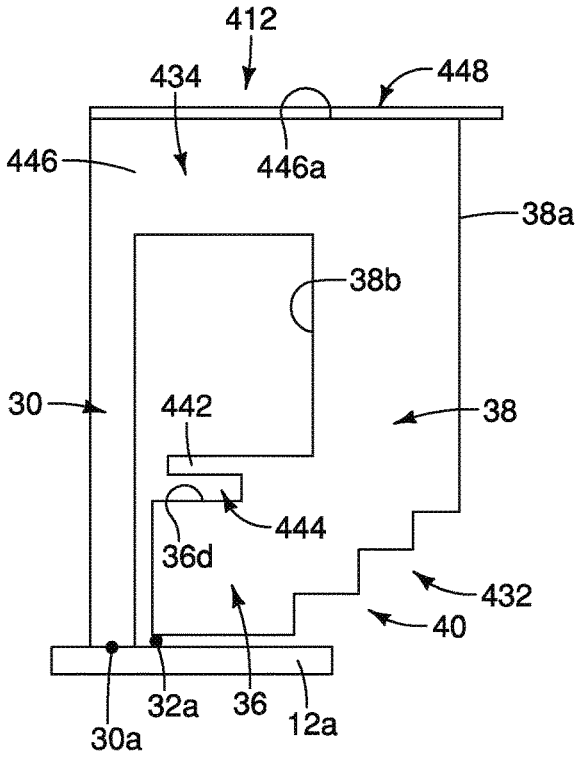
FIG. 7 is an elevational view of a half loop antenna in accordance with another alternate embodiment.

In the illustrated embodiment, as seen in FIG. 3, the feed section 32 includes the extension part 42 that faces opposite the inner edge 38*b* of the second feed portion 38 with the slot 44 therebetween. However, the feed section 32 can have a different extension part. Specifically, as seen in FIG. 7, a feed section 432 of a half loop antenna 412 in accordance with an alternate embodiment can have an extension part 442 that faces opposite the inner edge 36*d* of the first feed portion 36 with a slot 444 therebetween. Since the half loop antenna 412 is basically identical to the half loop antennas 12 and 14, the parts of the half loop antenna 412 that are identical to the parts of the half loop antennas 12 and 14 will be given the same reference numerals as the parts of the half loop antennas 12 and 14. Moreover, the descriptions of the parts of the half loop antenna 412 that are identical to the parts of the half loop antennas 12 and 14 may be omitted for the sake of brevity.

Specifically, in the illustrated embodiment, the extension part 442 is a horizontal extension that extends from the inner edge 38*b* of the second feed portion 38 toward the ground section 30. In the illustrated embodiment, the slot 444 has a straight shape. However, the slot 444 can have other shape, as needed and/or desired.

As seen in FIG. 7, the half loop antenna 412 is illustrated as including an intermediate section 434. Specifically, in the illustrated embodiment, the intermediate section 434 includes a base portion 446 and a bent portion 448. The base portion 446 is connected between the ground section 30 and the second feed portion 38 of the feed section 432. The bent portion 448 is bent relative to the base portion 446. In the illustrated embodiment, the bent portion 448 extends beyond the outer edge 38*a* of the second feed portion 38 along an outer edge 446*a* of the base portion 446. The outer edge 446*a* extends parallel to the longitudinal direction D1 of the antenna base 16. However, the intermediate section 434 can be similar to the intermediate sections 34 and 134 of the half loop antennas 12 and 14 or can be an intermediate section without a bent portion.

Figure 8:
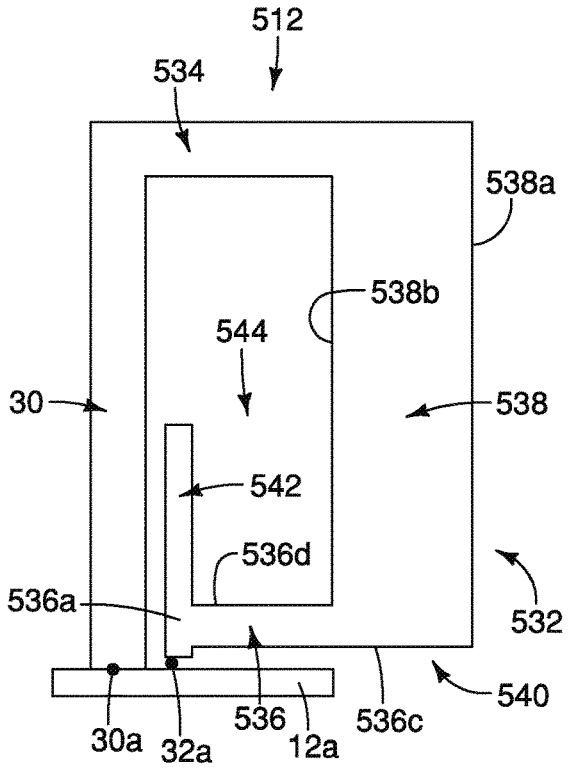
FIG. 8 is an elevational view of a half loop antenna in accordance with another alternate embodiment.

In the illustrated embodiment, as seen in FIG. 3, the corner portion 40 has the tapered outer edge 40*a*. However, the corner portion 40 can have a different outer edge. Specifically, as seen in FIG. 8, a feed section 532 of a half loop antenna 512 in accordance with an alternate embodiment can have a corner portion 540. Since the half loop antenna 512 is basically identical to the half loop antennas 12 and 14, the parts of the half loop antenna 512 that are identical to the parts of the half loop antennas 12 and 14 will be given the same reference numerals as the parts of the half loop antennas 12 and 14. Moreover, the descriptions of the parts of the half loop antenna 512 that are identical to the parts of the half loop antennas 12 and 14 may be omitted for the sake of brevity.

Specifically, as illustrated in FIG. 8, the corner portion 540 is formed between an outer edge 536*c* of a first feed portion 536 and an outer edge 538*a* of a second feed portion 538. In particular, the outer edge 536*c* of the first feed portion 536 and the outer edge 538*a* of the second feed portion 538 converge to meet with each other and form the corner portion 540 therebetween as an outside corner.

As also seen in FIG. 8, the feed section 532 of the half loop antenna 512 is illustrated as having an extension part 542 that faces opposite an inner edge 538*b* of the second feed portion 538 with a slot 544 therebetween. Specifically, in the illustrated embodiment, the extension part 542 is an upright extension that extends from an inner edge 536*d* of the first feed portion 536 toward an intermediate section 534. In particular, the extension part 542 extends from the inner edge 536*d* of the first feed portion 536 at a first end 536*a* of the first feed portion 536.

In the illustrated embodiment, as seen in FIG. 8, the intermediate section 534 is connected between the ground section 30 and the second feed portion 538 of the feed section 532. The intermediate section 534 is configured without a bent portion. However, the intermediate section 534 can have a bent portion that is similar to the bent portions 48 and 148 of the intermediate sections 34 and 134 of the half loop antennas 12 and 14.

Figure 9:
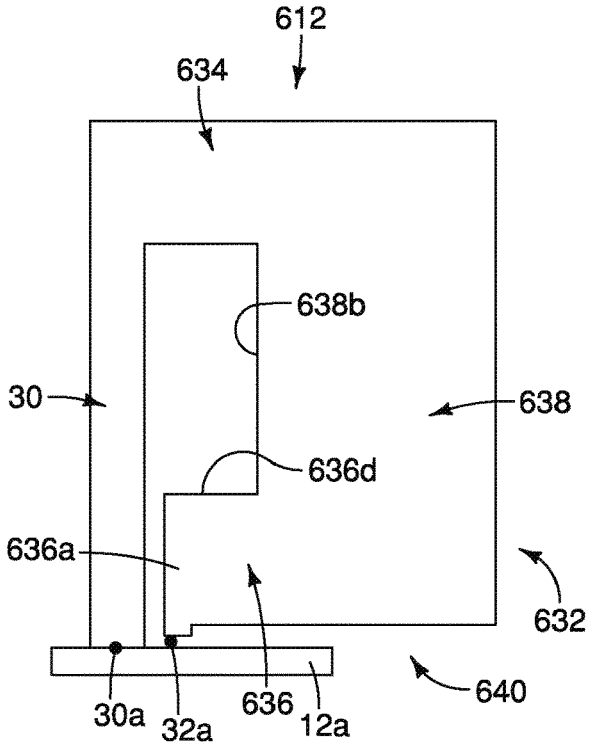
FIG. 9 is an elevational view of a half loop antenna in accordance with another alternate embodiment.

Furthermore, the half loop antenna 512 can further be modified to remove the extension portion 542. Specifically, as seen in FIG. 9, a half loop antenna 612 in accordance with an alternate embodiment can be configured without an extension portion. Since the half loop antenna 612 is basically identical to the half loop antenna 512, the parts of the half loop antenna 612 that are identical to the parts of the half loop antenna 512 will be given the same reference numerals as the parts of the half loop antenna 512. Also, the parts of the half loop antenna 612 that are substantially identical to or functionally or structurally correspond to the parts of the half loop antenna 512 will be given the same reference numerals but with "100" added thereto. Moreover, the descriptions of the parts of the half loop antenna 612 that are identical to the parts of the half loop antenna 512 may be omitted for the sake of brevity.

Specifically, in the illustrated embodiment, as seen in FIG. 9, the half loop antenna 612 basically includes the ground section 30 and a feed section 632. The half loop antenna 612 further includes an intermediate section 634. The ground section 30 has the ground point 30*a* that is configured to be electrically grounded. The feed section 632 is configured to be electrically connected to the ground section 30. The feed section 632 includes a first feed portion 636 and a second feed portion 638. The first feed portion 636 has the feed point 32*a* that is configured to be electrically connected to the coaxial cable CB (e.g., the antenna feed) (FIG. 3). The second feed portion 638 is connected to the first feed portion 636 via a corner portion 640 therebetween. The corner portion 640 is located farther from the ground point 30*a* than the feed point 32*a*.

In the illustrated embodiment, the feed section 632, the intermediate section 634, the first feed portion 636, the second feed portion 638, the corner portion 640 are basically identical to the feed section 532, the intermediate section 534, the first feed portion 536, the second feed portion 538, the corner portion 540 of the half loop antenna 512 shown in FIG. 8, respectively, except for the sizes or dimensions thereof and except for the feed section 532 having the extension part 542. Specifically, as seen in FIG. 9, the feed section 632 of the half loop antenna 612 is configured without an extension part. Thus, in the illustrated embodiment, an inner edge 636*d* of the first feed portion 636 extends straight parallel to the longitudinal direction D1 of the antenna base 16 from a first end 636*a* of the first feed portion 636 to an inner edge 638*b* of the second feed portion 638.

Referring now to FIGS. 10 to 50, the effects of the the present disclosure will be described in detail.

As mentioned above, when LPA devices include MIMO antennas for cellular signals, monopole antennas are conventionally utilized as cellular antennas. However, it has been discovered that these monopole type antennas needs to be further improved to meet bandwidth and gain requirements.

Figure 10:
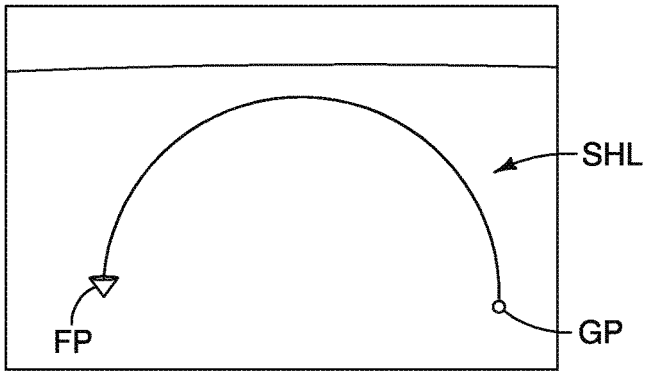
FIG. 10 is an elevational view of a simple wire loop antenna in accordance with a comparative example.
Figure 11:
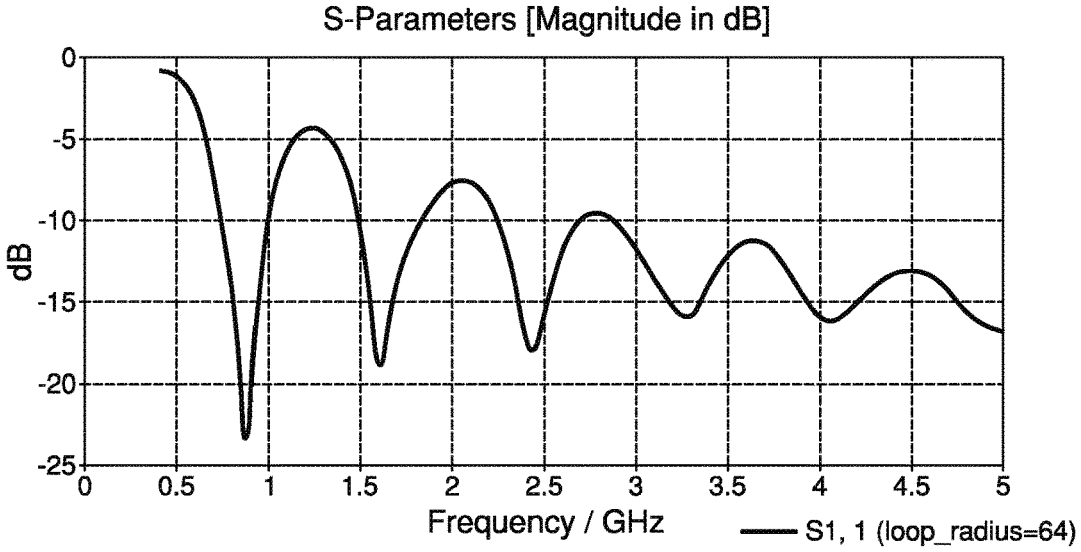
FIG. 11 is a graph showing a return loss of the simple wire half loop antenna illustrated in FIG. 10.

In order to achieve the bandwidth and gain requirements, providing a half loop or half wavelength loop antenna to a vehicular antenna device has been conceived by the inventor. Loop antennas are usually formed when conductor length approaches one wavelength in free space. Loop antennas are also mainly used as directional types of antennas, and are usually electrically large. To remove directionality associated with an open loop section of the loop antennas, a simple wire half loop antenna SHL with a feed point FP and a ground point GP, as seen in FIG. 10, has been considered to be provided to a vehicular antenna device. FIG. 11 illustrates a return loss of the simple wire half loop antenna SHL, while FIG. 12 illustrates a smith chart showing an impedance of the simple wire loop antenna SHL.

In the illustrated embodiment, the simple wire half loop antenna SHL has further been transformed to the wideband half loop antennas as illustrated in FIGS. 1 to 9 to further improve the return loss and the gain required for telecommunications from 0.6 GHz to 6 GHz.

Specifically, various techniques have been conceived and applied to the simple wire half loop antenna SHL to create the wideband half loop antennas as illustrated in FIGS. 1 to 9. These techniques include increasing width of a feed section of the wideband half loop antennas, making the feed section tapered or curved off to increase bandwidth. Furthermore, these techniques include adjusting the structure of the wideband half loop antennas through characteristic modal analysis (CMA) technique to excite omnidirectional modal currents for high frequency.

Figure 12:
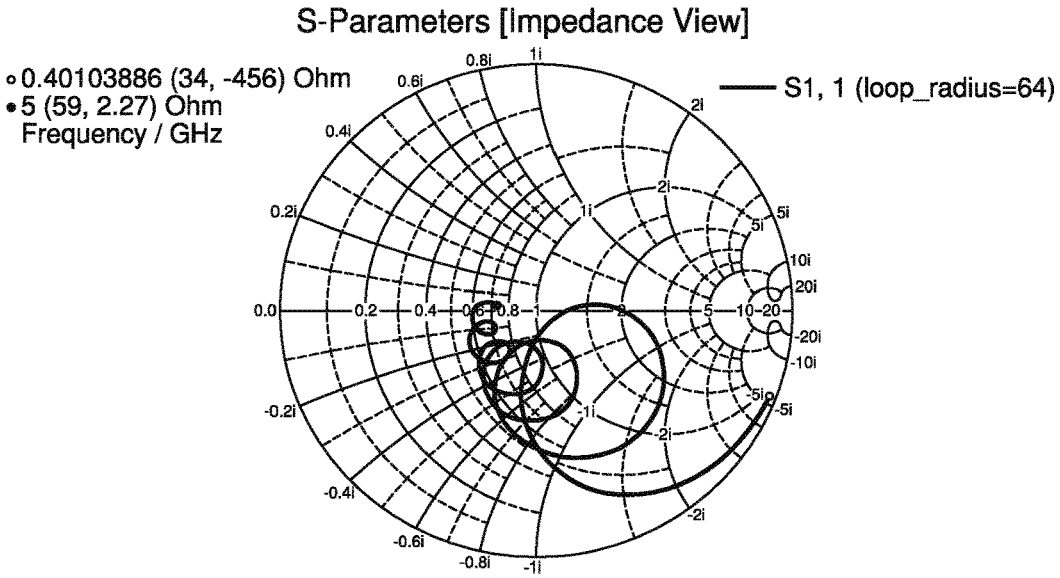
FIG. 12 is a smith chart showing an impedance of the simple wire loop antenna illustrated in FIG. 10.

More specifically, as seen in FIG. 12, the simple wire half loop antenna SHL has a large impedance bandwidth after f0 (fundamental frequency or first order frequency). It is also important to be able to tap into wideband performance for higher frequency bands. Furthermore, the simple wire half loop antenna SHL needs to be transformed into a smaller shape to fit inside a low profile antenna (LPA) device. This has been done by reducing an overall width or dimension of the simple half loop antenna SHL measured from the ground point GP to the feed point FP while retaining its peak height.

Figure 13:
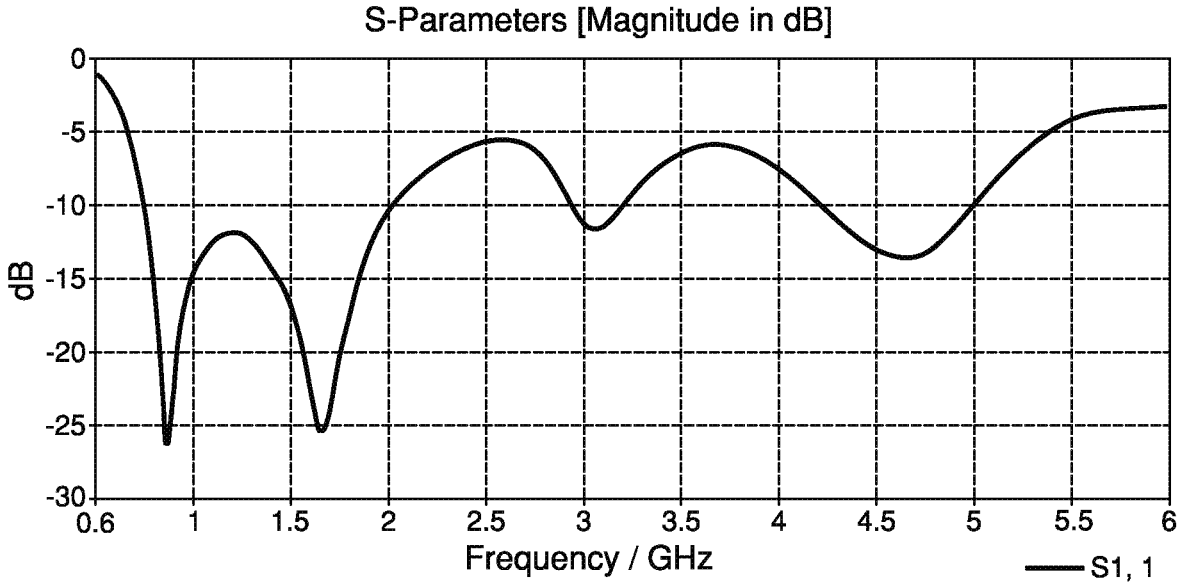
FIG. 13 is a graph showing a return loss of the half loop antenna illustrated in FIG. 9.
Figure 14:
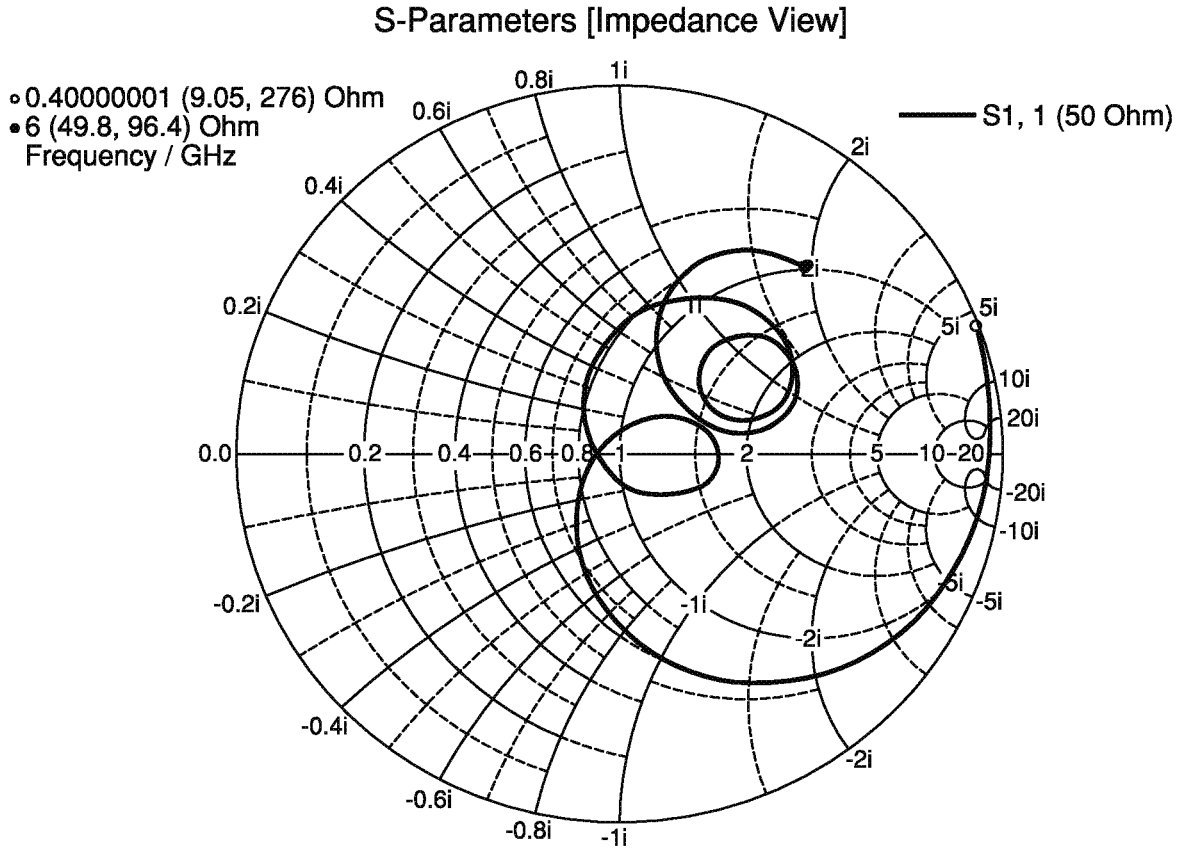
FIG. 14 is a smith chart showing an impedance of the half loop antenna illustrated in FIG. 9.

With these techniques, the half loop antennas 512 and 612 as seen in FIGS. 8 and 9 have been created, for example. Specifically, with the half loop antenna 612 as seen in FIG. 9, a width of the second feed portion 638 is increased relative to a width of the ground section 30, which can increase the bandwidth of the half loop antenna 612. FIG. 13 illustrates a return loss of the half loop antenna 612, while FIG. 14 illustrates a smith chart showing an impedance of the half loop antenna 612.

Similarly, with the half loop antenna 512 as seen in FIG. 8, a width of the second feed portion 538 is increased relative to a width of the ground section 30, which can increase the bandwidth of the half loop antenna 512.

As also seen in FIG. 12, the smith chart for the simple wire half loop antenna SHL shows that the simple wire half loop antenna SHL needs more inductance. To add this inductance, a tunable structure of the half loop antenna 512 has been created. In particular, as seen in FIG. 8, this structure adds the inductance by decreasing a width of the first feed portion 536 in a direction perpendicular to the longitudinal direction D1 of the antenna base 16 while increasing a width of the second feed portion 538.

Furthermore, with the half loop antenna 512, the extension part 542 has been added as an additional upturned element to the first feed portion 536 to help adjust capacitance issues. In particular, this additional upturned element creates capacitive element to ground connection.

Figure 15:
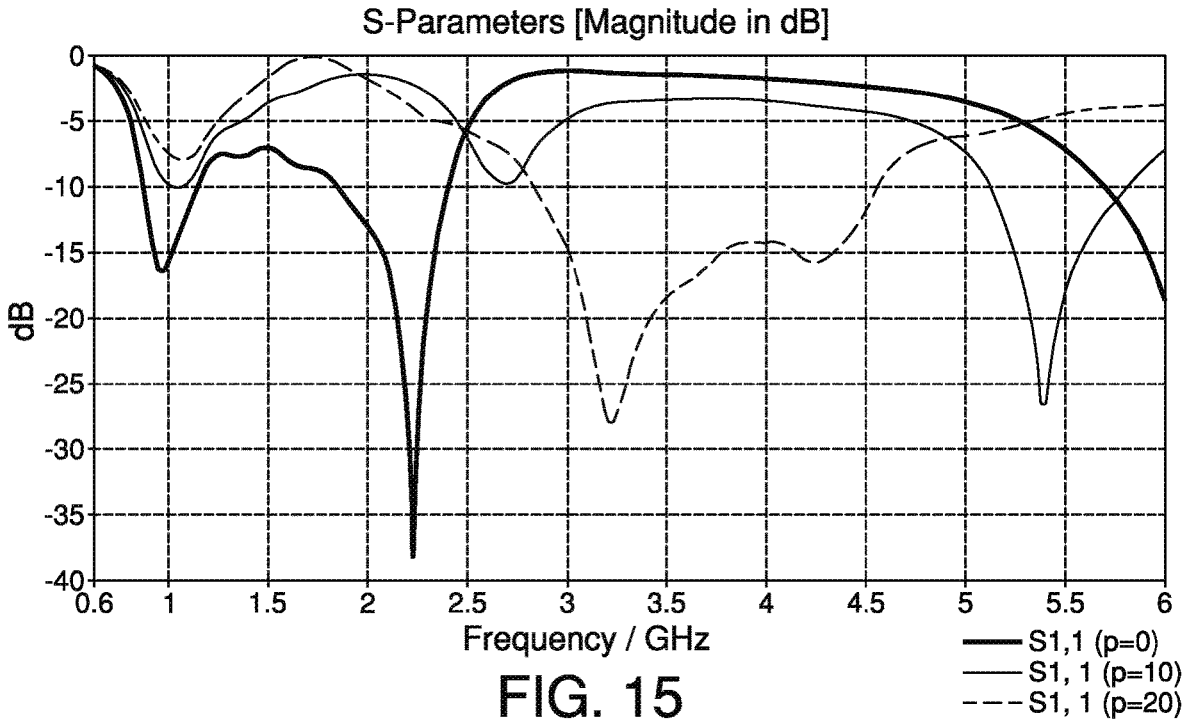
FIG. 15 is a graph showing return losses of the half loop antenna illustrated in FIG. 8 for different feed positions.

Moreover, in the illustrated embodiment, an optimal position of the feed point 32*a* has been discovered. Specifically, with the half loop antenna 512, it has been discovered that as the feed point 32*a* moving away from the first end 536*a* along the outer edge 536*c* of the first feed portion 536, the impedance matches for different frequency bands that are desired to be supported. FIG. 15 illustrates return losses of the half loop antenna 512 for different feed positions (0 mm, 10 mm and 20 mm from the first end 536*a*). With this analysis, in the illustrated embodiment, the feed point 32*a* has been determined to be located at the first end 536*a* (i.e., 0 mm from the first end 536*a*). However, the feed point 32*a* can be located at different positions for different needs or purposes.

After these transformations of the structure, it becomes able to support impedance match for wide band as supported by feed experiment. However, higher frequencies can still be improved for impedance match. In particular, as seen in FIG. 14, in the impedance of the half loop antenna 612, the higher frequencies tended to be inductive compared to the lower frequencies.

Figure 16:
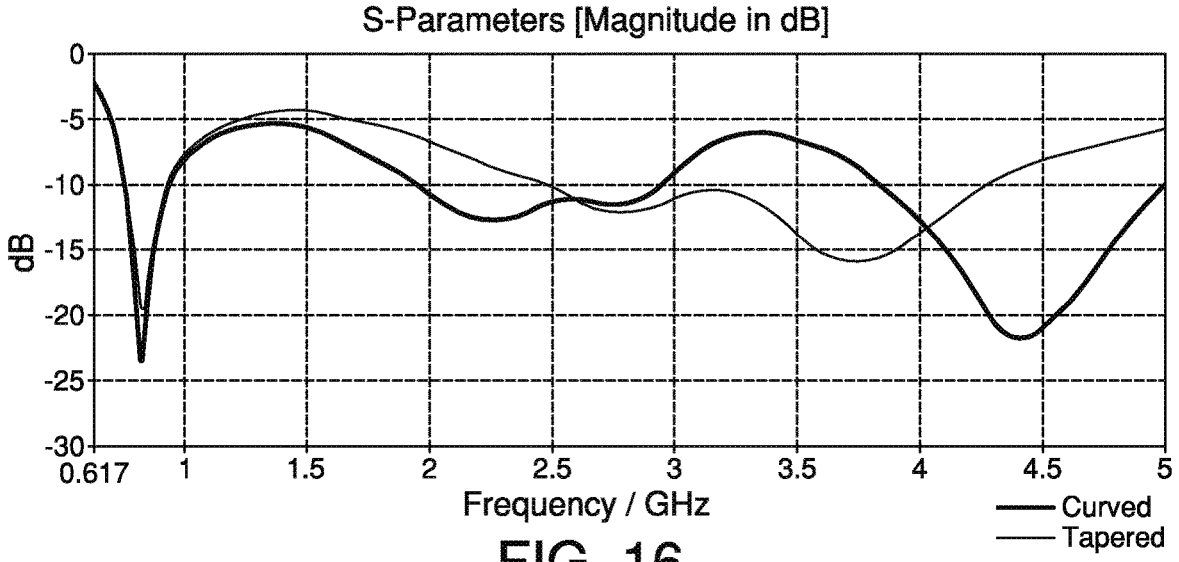
FIG. 16 is a graph showing return losses of half loop antennas with curved or tapered outer edge designs.
Figure 17:
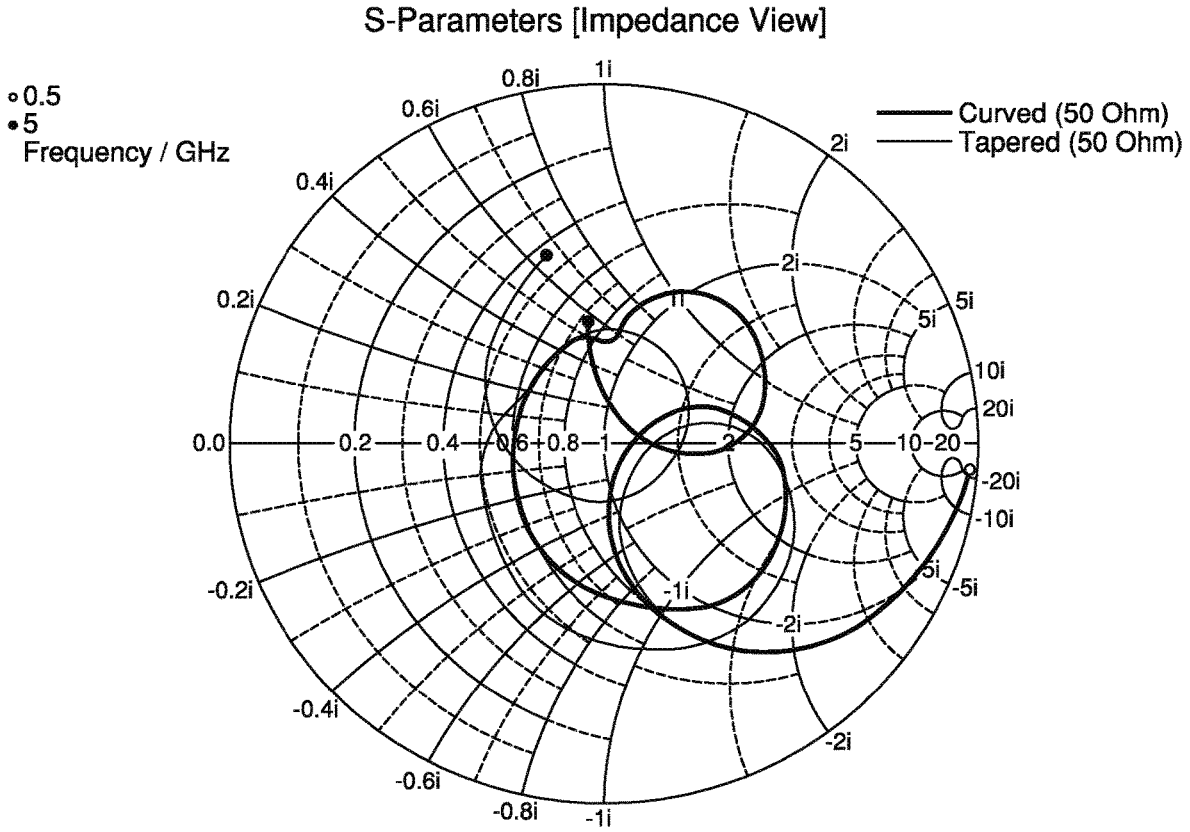
FIG. 17 is a smith chart showing impedances of the half loop antennas with the curved or tapered outer edge designs.

To further improve the impedance match for higher frequencies, curved or tapered outer edge designs have been created (i.e., half loop antennas with a tapered outer edge 40*a* or a curved outer edge 240*a*). FIG. 16 illustrates return losses of half loop antennas with the curved or tapered outer edge designs, while FIG. 17 illustrates a smith chart showing impedances of the half loop antennas with the curved or tapered outer edge designs. In particular, FIG. 16 illustrates a return loss of the half loop antenna 312 with the curved outer edge 240*a* ("Curved" in FIG. 16), while FIG. 17 illustrates a smith chart showing an impedance of the half loop antenna 312 ("Curved" in FIG. 17) FIG. 16 also illustrates a return loss of a half loop antenna with a tapered outer edge ("Tapered" in FIG. 16) that is identical to the half loop antenna 14 with the tapered outer edge 40*a*, except for that this half loop antenna does not have the bent portion 148, while FIG. 17 also illustrates a smith chart showing an impedance of this half loop antenna ("Tapered" in FIG. 17). As seen in FIG. 17, the curved or tapered outer edge designs bring the inductive nature of the high frequencies down to the capacitive side.

Figure 18:
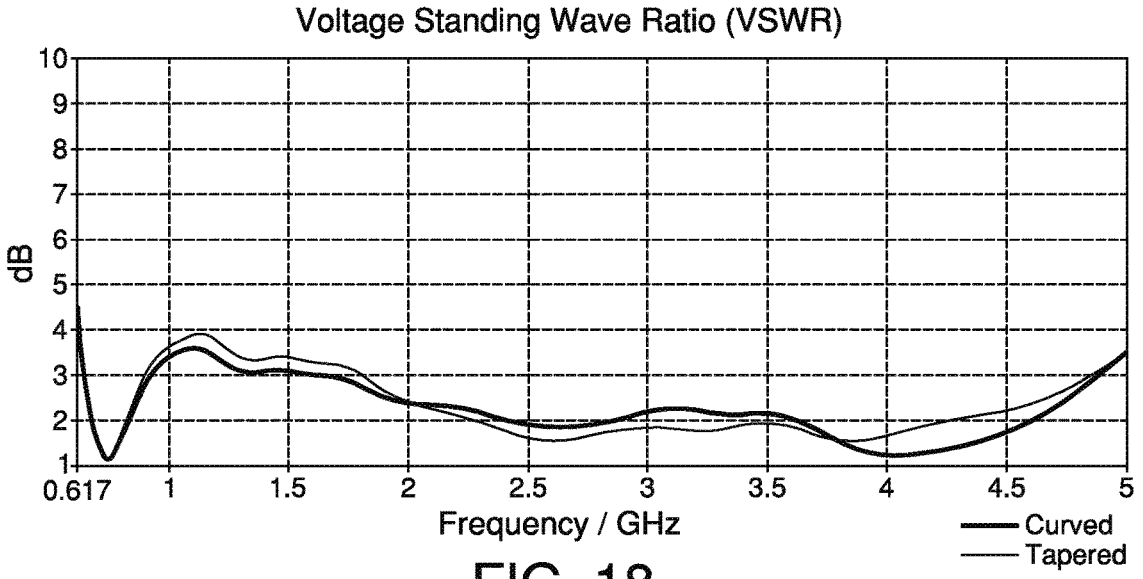
FIG. 18 is a graph showing voltage standing wave ratios (VSWR) of resulting structures through CMA.
Figure 19:
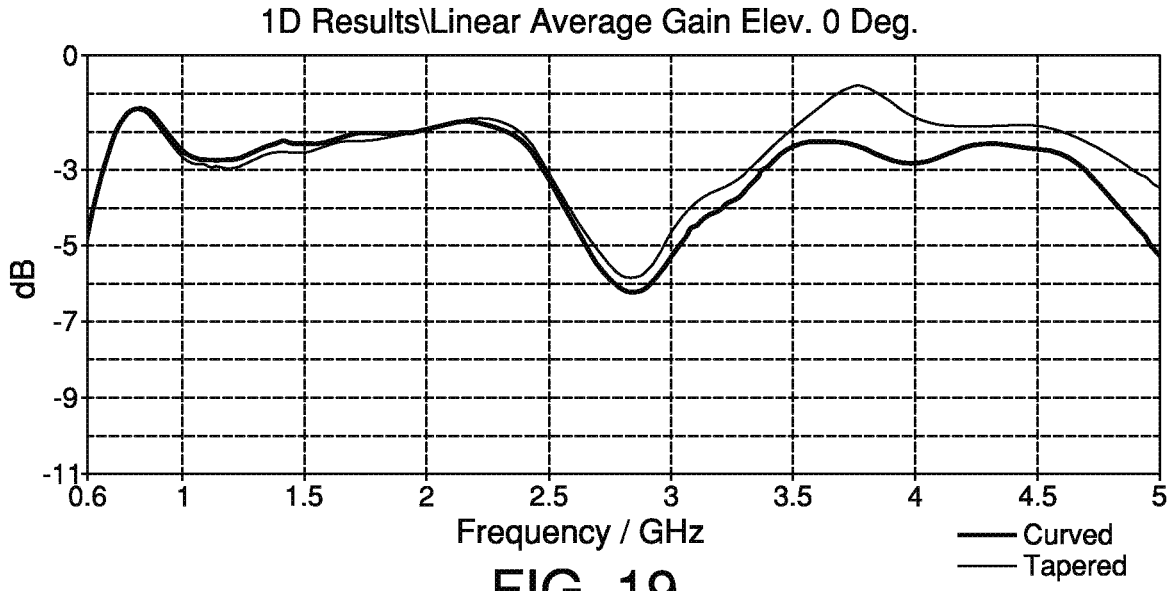
FIG. 19 is a graph showing average gains at 0 degrees elevation of the resulting structures.
Figure 20:
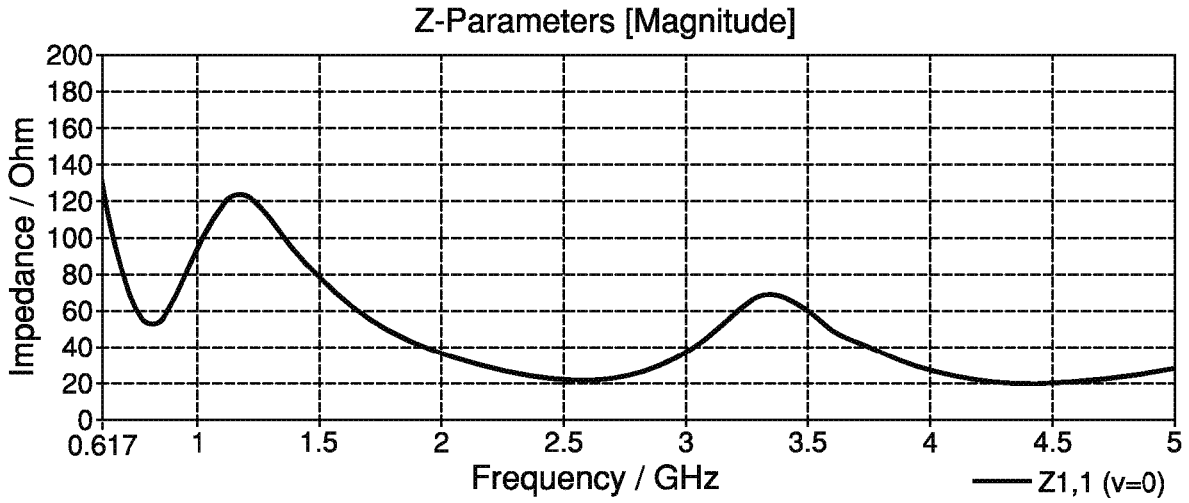
FIG. 20 is a graph showing an impedance of the resulting structure labeled as "Tapered" in FIGS. 18 and 19 across 5G frequency bands.

With these half loop antennas with the curved or tapered outer edge designs, impedance match across a wide band can be achieved. On the other hand, the modal currents for higher frequencies tend to create a farfield pattern similar to patch antennas. To address this, a characteristic modal analysis (CMA) has been done to study modal currents for those frequencies and to further modify the structure of the half loop antennas, especially to modify a mid-section structure of the half loop antennas. FIG. 18 illustrates voltage standing wave ratios (VSWR) of resulting structures through the CMA, while FIG. 19 illustrates average gains at 0 degrees elevation of the resulting structures. Specifically, in FIGS. 18 and 19, a resulting structure started from the half loop antenna 312, which is indicated as "Curved" in FIGS. 16 and 17, is also labeled as "Curved", while a resulting structure started from the half loop antenna with the tapered outer edge, which is indicated as "Tapered" in FIGS. 16 and 17, in also labeled as "Tapered". FIG. 20 illustrates an impedance of the resulting structure labeled as "Tapered" in FIGS. 18 and 19 across 5G frequency bands.

Through the CMA, it has been discovered that providing the L-shaped slot 44 can interrupt the dominate modal currents creating the patch farfield and force excitation of lower order modes causing the farfield to become omnidirectional in shape for higher frequencies. On the other hand, the modal currents for the lower frequencies bands which already have a dominate omnidirectional farfield pattern are unaffected. This is because most of those currents flow strongly around the outer loop and down to the ground section 30 for those frequencies. With the resulting structures through the CMA, the dominate effect of the lower order modes can be increased.

Generally, the maximum height of the LPA device is set by predetermined standards. Therefore, to maximize gain at lower frequencies and impedance match, the top sections of the resulting structures through the CMA are further folded to create the half loop antennas 12, 14 and 212. In the illustrated embodiment, the top sections of the resulting structures through the CMA are folded by 15 mm. However, the folded length can be different as needed and/or desired.

Figure 21:
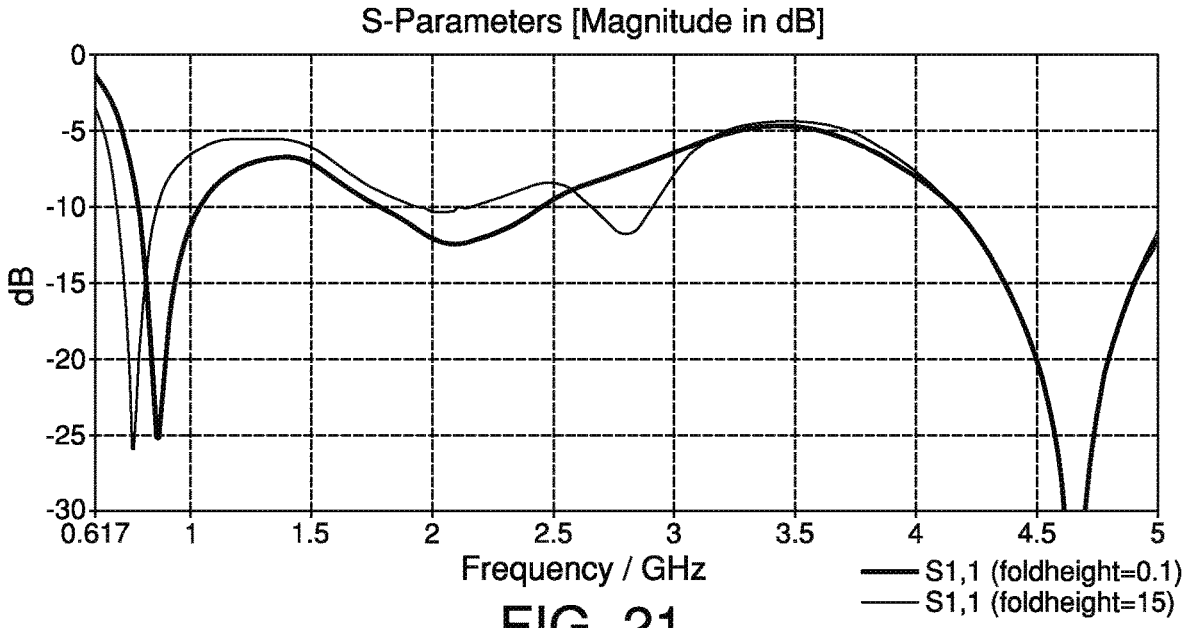
FIG. 21 is a graph showing a fundamental frequency shift of the half loop antenna illustrated in FIG. 4 relative to the half loop antenna illustrated in FIG. 6.
Figure 22:
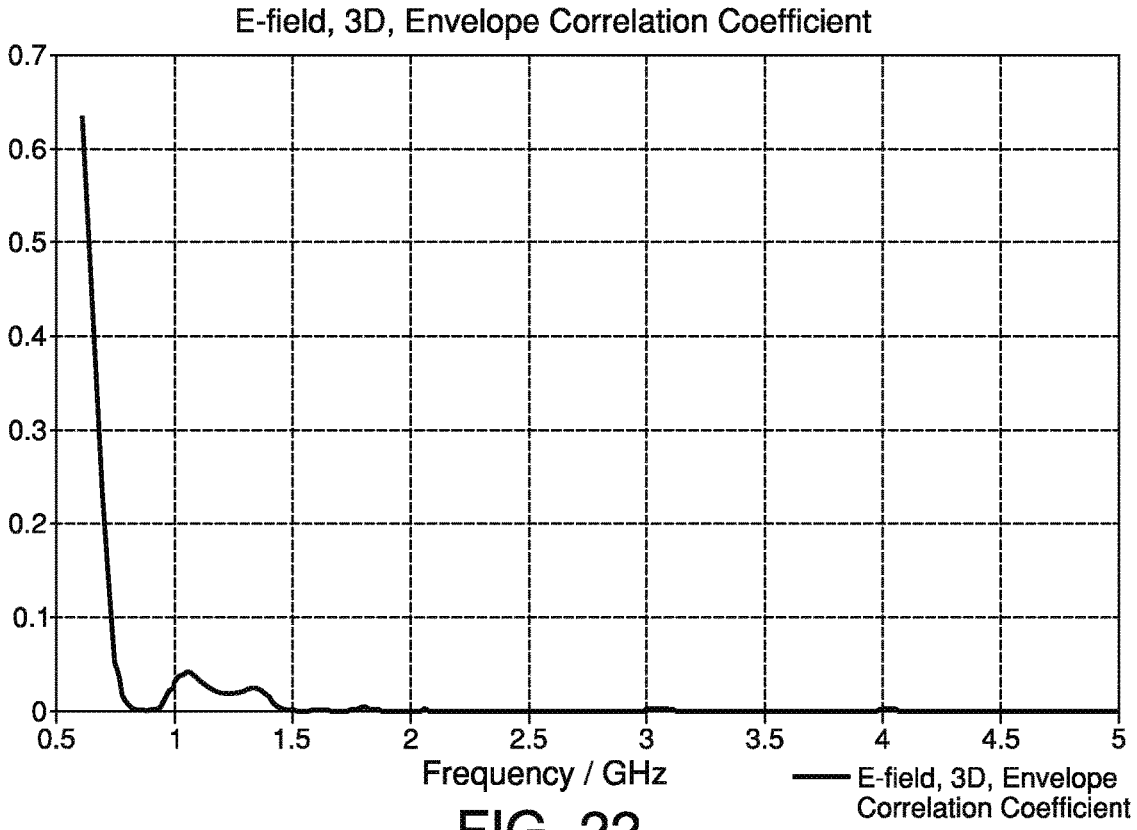
FIG. 22 is a graph showing an envelope correlation coefficient for the half loop antenna illustrated in FIG. 4.

FIG. 21 illustrates a fundamental frequency shift of the half loop antenna 212 as shown in FIGS. 4 and 5 ("foldheight=15" in FIG. 21) relative to the half loop antenna 312 as shown in FIG. 6 ("foldheight=0.1" in FIG. 21). Furthermore, FIG. 22 illustrates an envelope correlation coefficient for the half loop antenna 212 as shown in FIGS. 4 and 5.

Figure 23:
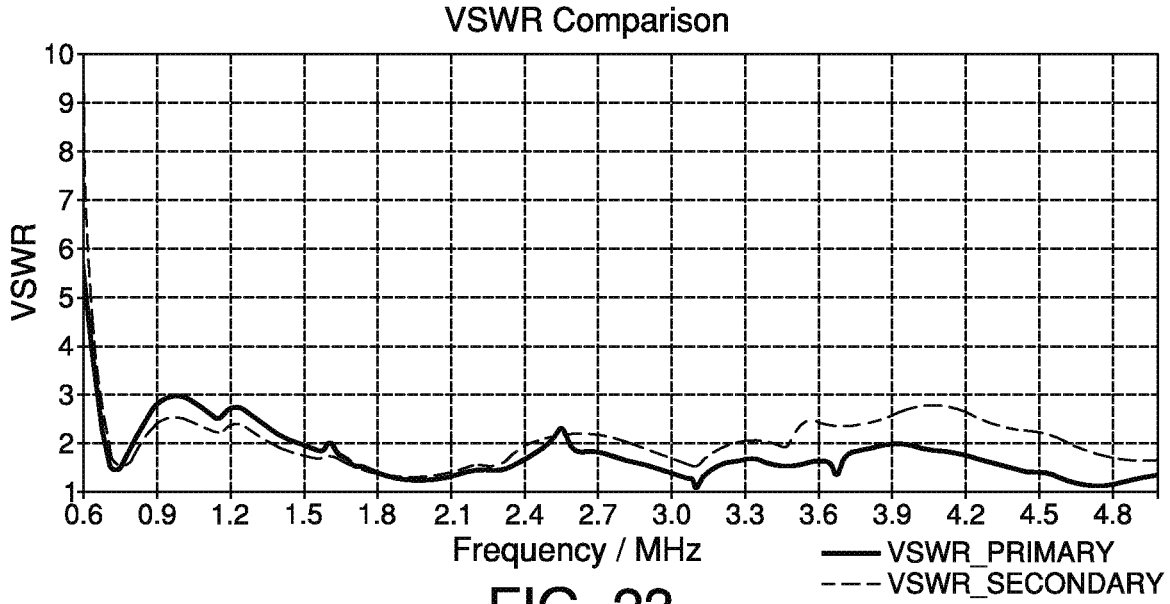
FIG. 23 is a graph showing voltage standing wave ratios (VSWR) of the half loop antennas shown in FIG. 1.
Figure 24:
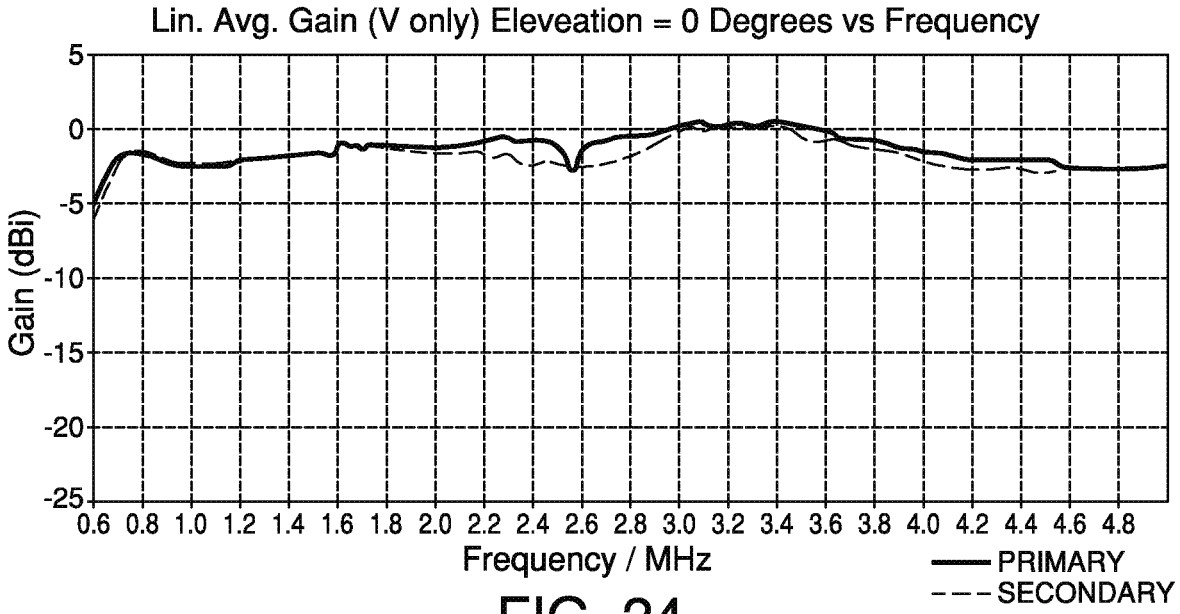
FIG. 24 is a graph showing average gains at 0 degrees elevation of the half loop antennas shown in FIG. 1.

Through these transformations of the simple wire half loop antenna SHL as shown in FIG. 10, the half loop antennas 12, 14, 212, 312, 412, 512 and 612 of the present disclosure are obtained. FIG. 23 illustrates the VSWR of the half loop antennas 12 and 14, while FIG. 24 illustrates average gains at 0 degrees elevation of the half loop antennas 12 and 14.

Furthermore, as mentioned above, when multiple cellular antennas are utilized in LPA devices, sufficient isolation between these cellular antennas needs to be ensured. There are several methods to increase isolation of two closely packed antenna elements. These include a spatial diversity, a pattern diversity, a polarization diversity, and transmit/receive diversity. In the illustrated embodiment, the spatial diversity is focused, for example. In particular, in the illustrated embodiment, as seen in FIGS. 1 to 3, the half loop antennas 12 and 14 are arranged relative to each other such that the ground sections 30 of the half loop antennas 12 and 14 face toward each other. With this arrangement of the half loop antennas 12 and 14, isolation between the half loop antennas 12 and 14 at the fundamental frequency (f0) can be increased. However, as illustrated in FIGS. 25 to 37B, it has also been discovered that by arranging a ground section of one of two half loop antennas to face toward a feed section of the other one of the two half loop antennas, isolation between the two half loop antennas at the fundamental frequency (f0) can still be increased relative to a comparative configuration in which two monopole antennas are arranged relative to each other.

Figure 25:
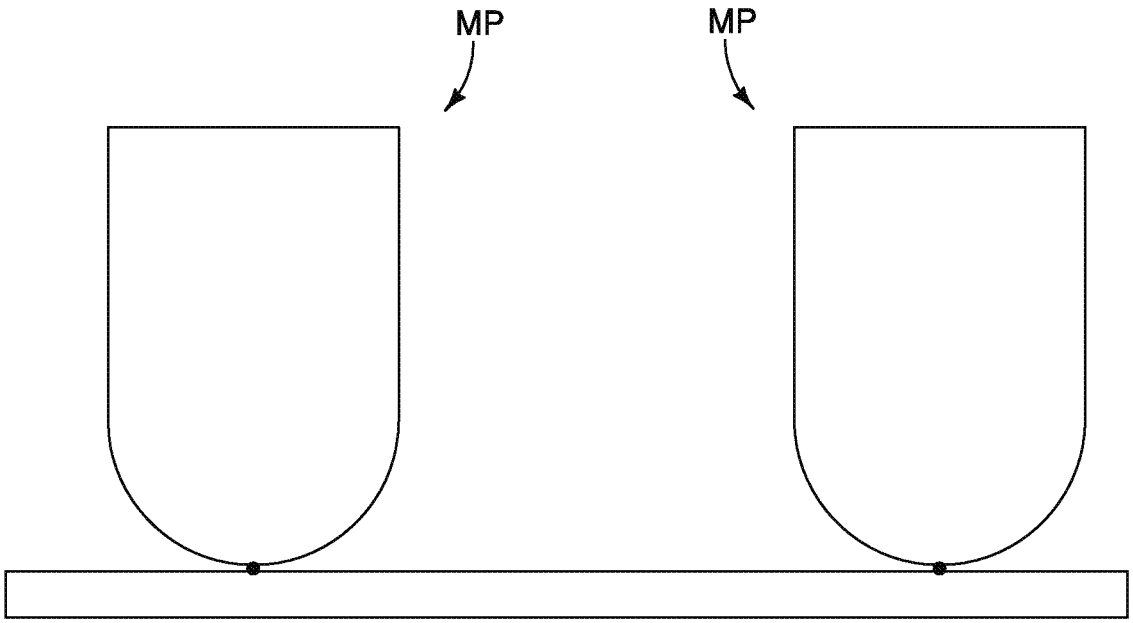
FIG. 25 is an elevational view of a comparative configuration in which two monopole antennas are arranged relative to each other.
Figure 26:
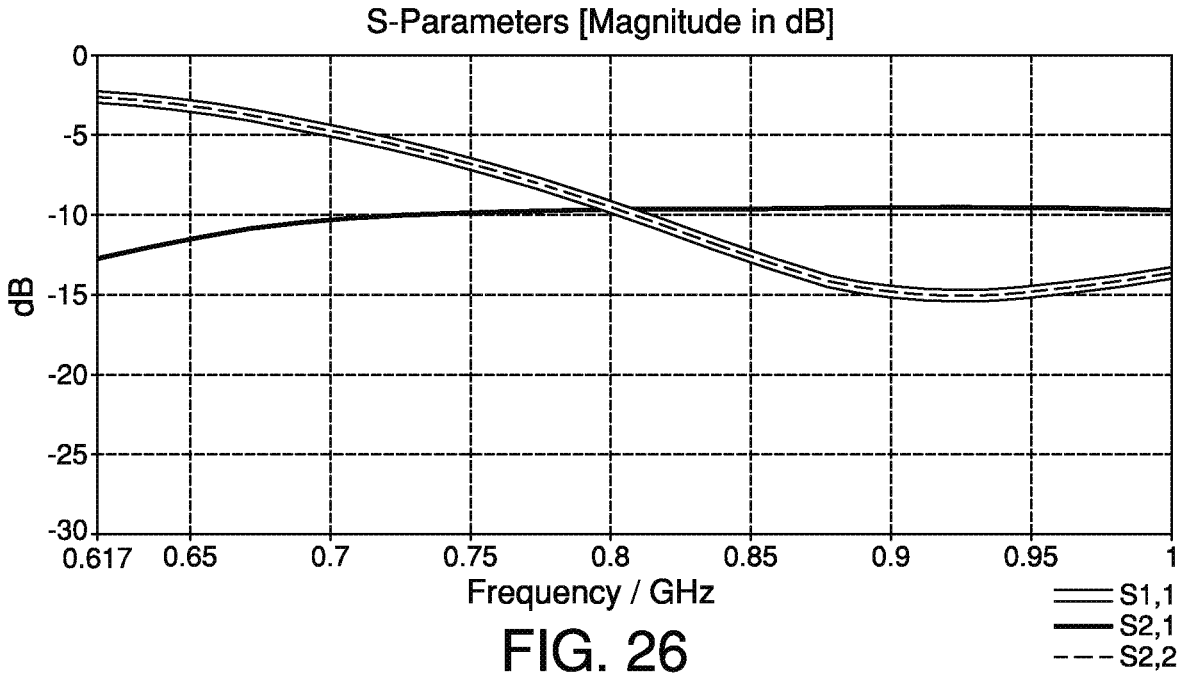
FIG. 26 is a graph showing return losses of the monopole antennas shown in FIG. 25 and an isolation between the monopole antennas shown in FIG. 25 at a fundamental frequency (f0)

Specifically, FIG. 25 illustrates the comparative configuration in which two monopole antennas MP are arranged relative to each other, while FIG. 26 illustrates return losses (S11, S22) of the monopole antennas MP and an isolation (S21) between the monopole antennas MP at the fundamental frequency (f0).

Figure 27:
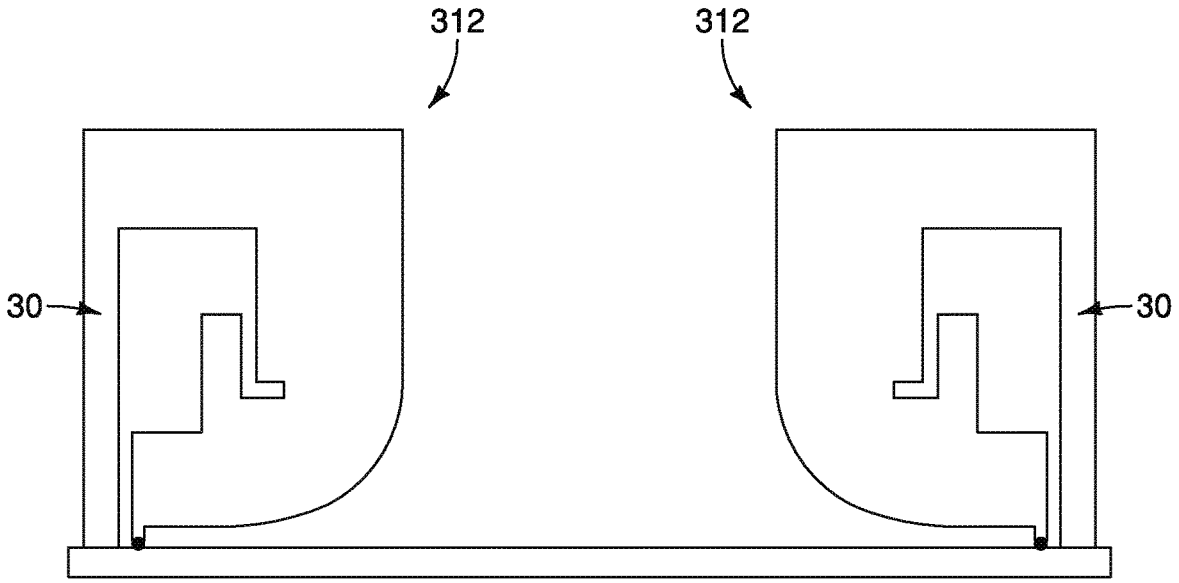
FIG. 27 is an elevational view of a first configuration in which two of the half loop antennas illustrated in FIG. 6 are arranged relative to each other with ground sections thereof facing away from each other.
Figure 28:
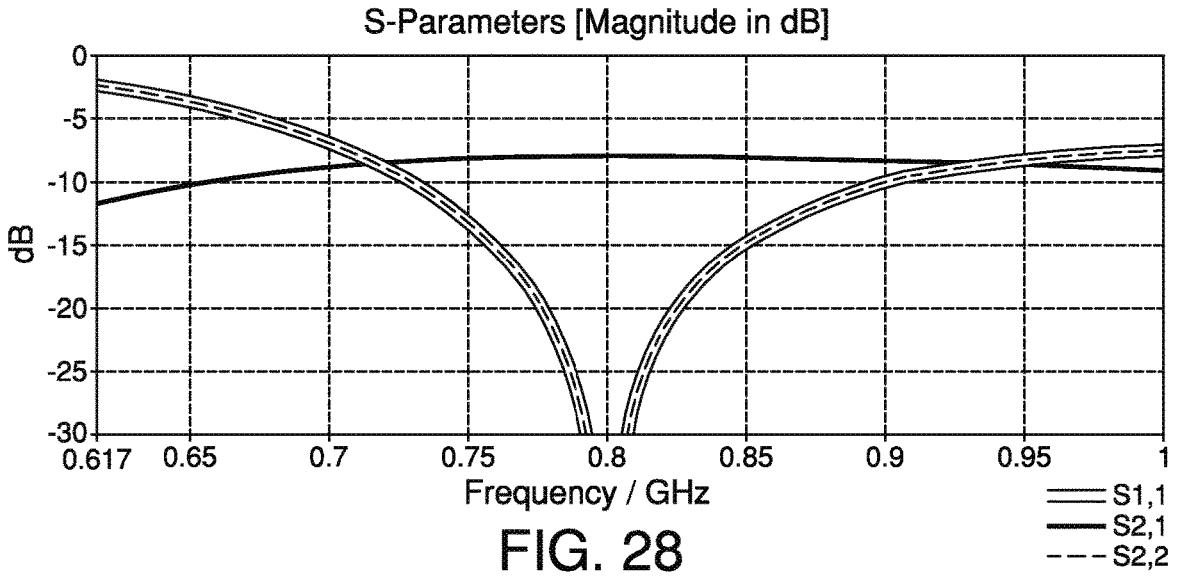
FIG. 28 is a graph showing return losses of the half loop antennas and an isolation between the half loop antennas at the fundamental frequency (f0) in the first configuration shown in FIG. 27.
Figure 29:
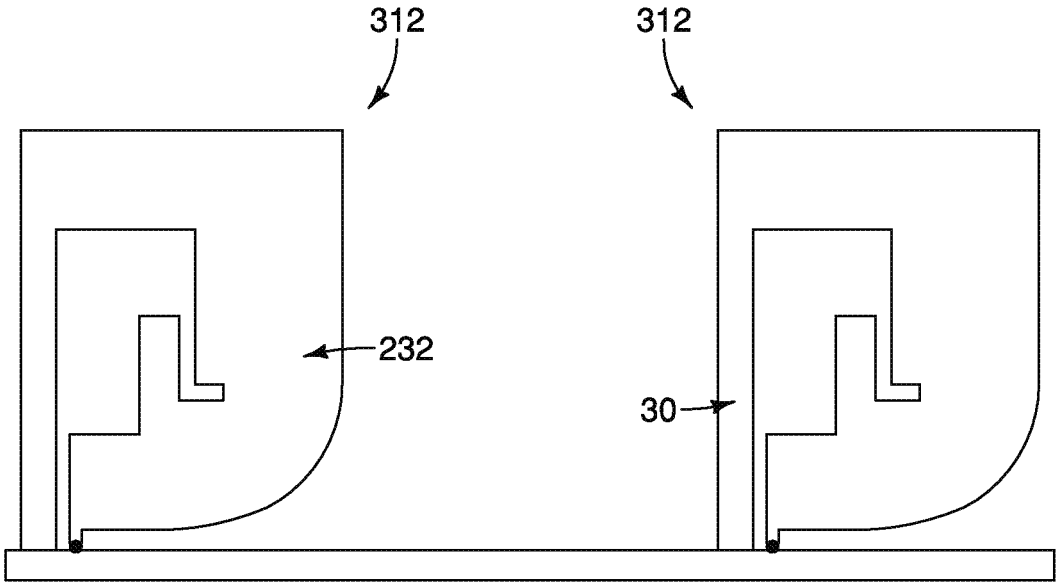
FIG. 29 is an elevational view of a second configuration in which two of the half loop antennas illustrated in FIG. 6 are arranged relative to each other with a ground section of one of the half loop antennas facing toward a feed section of the other one of the half loop antennas.
Figure 30:
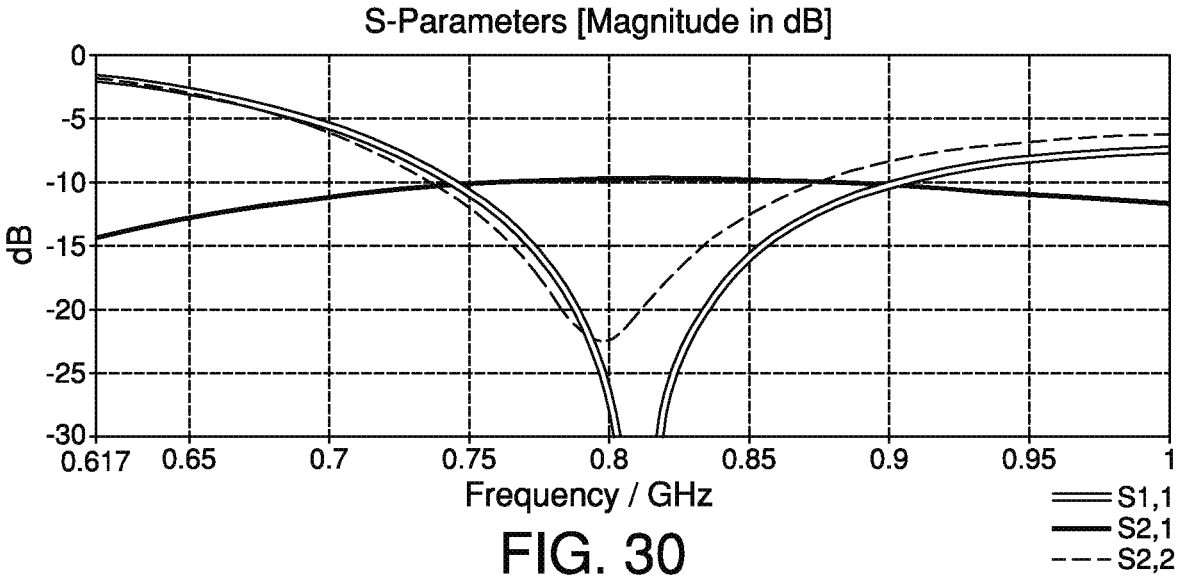
FIG. 30 is a graph showing return losses of the half loop antennas and an isolation between the half loop antennas at the fundamental frequency (f0) in the second configuration shown in FIG. 29.
Figure 31:
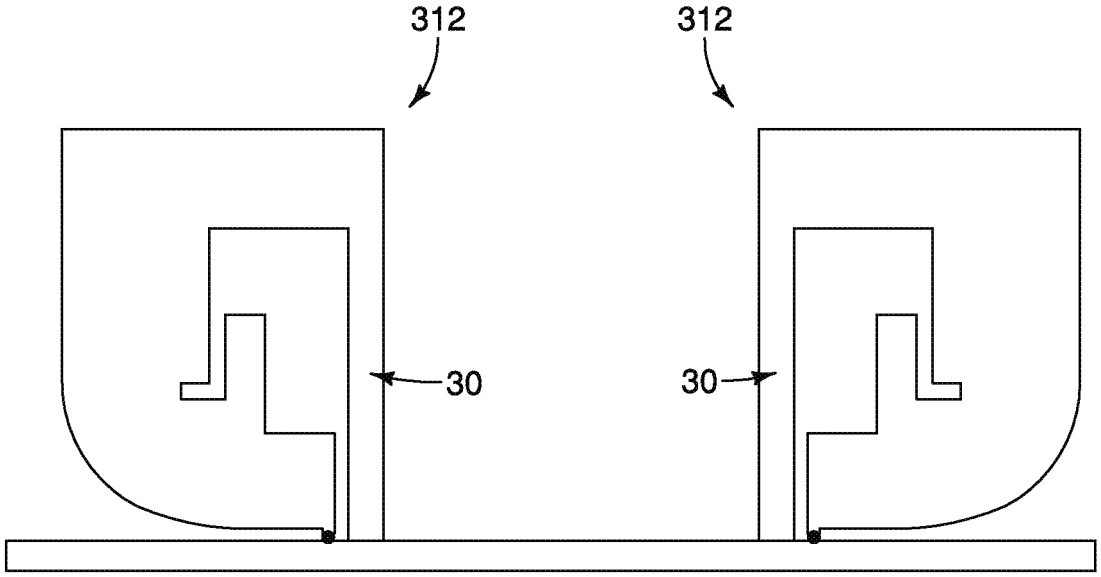
FIG. 31 is an elevational view of a third configuration in which two of the half loop antennas illustrated in FIG. 6 are arranged relative to each other with the ground sections thereof facing toward each other.
Figure 32:
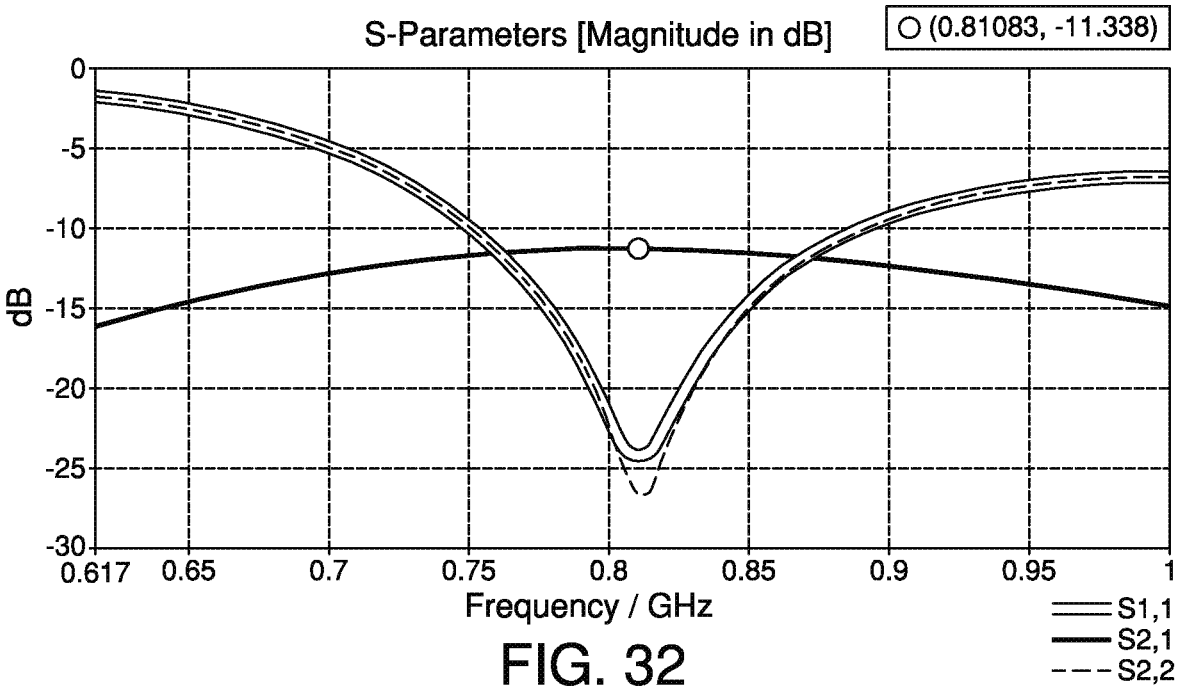
FIG. 32 is a graph showing return losses of the half loop antennas and a narrow band isolation between the half loop antennas in the third configuration shown in FIG. 31.
Figure 33:
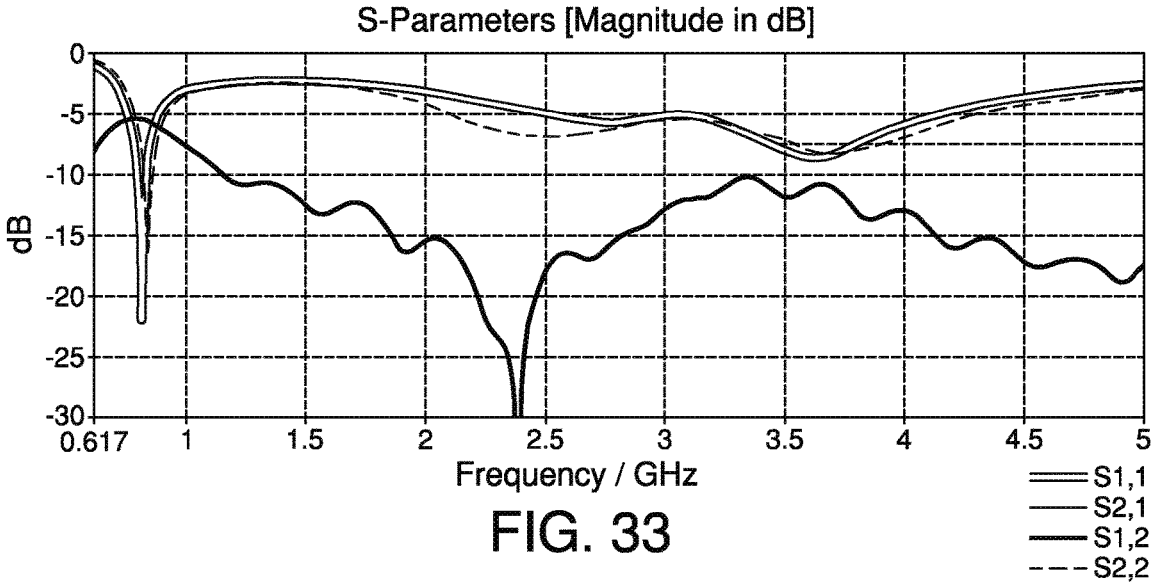
FIG. 33 is a graph showing return losses of the half loop antennas and a wide band isolation between the half loop antennas in the third configuration shown in FIG. 31.

On the other hand, FIG. 27 illustrates a first configuration in which two of the half loop antennas 312, as seen in FIG. 6, are arranged relative to each other with the ground sections 30 thereof facing away from each other, while FIG. 28 illustrates return losses (S11, S22) of the half loop antennas 312 and an isolation (S21) between the half loop antennas 312 at the fundamental frequency (f0) in the first configuration shown in FIG. 27. Furthermore, FIG. 29 illustrates a second configuration in which two of the half loop antennas 312, as seen in FIG. 6, are arranged relative to each other with the ground section 30 of one of the half loop antennas 312 facing toward the feed section 232 of the other one of the half loop antennas 312, while FIG. 30 illustrates return losses (S11, S22) of the half loop antennas 312 and an isolation (S21) between the half loop antennas 312 at the fundamental frequency (f0) in the second configuration shown in FIG. 29. Moreover, FIG. 31 illustrates a third configuration in which two of the half loop antennas 312, as seen in FIG. 6, are arranged relative to each other with the ground sections 30 thereof facing toward each other. FIG. 32 illustrates return losses (S11, S22) of the half loop antennas 312 and a narrow band isolation (S21) between the half loop antennas 312 in the third configuration shown in FIG. 31, while FIG. 33 illustrates return losses (S11, S22) of the half loop antennas 312 and a wide band isolation (S21, S12) between the half loop antennas 312 in the third configuration shown in FIG. 31.

Figure 34:
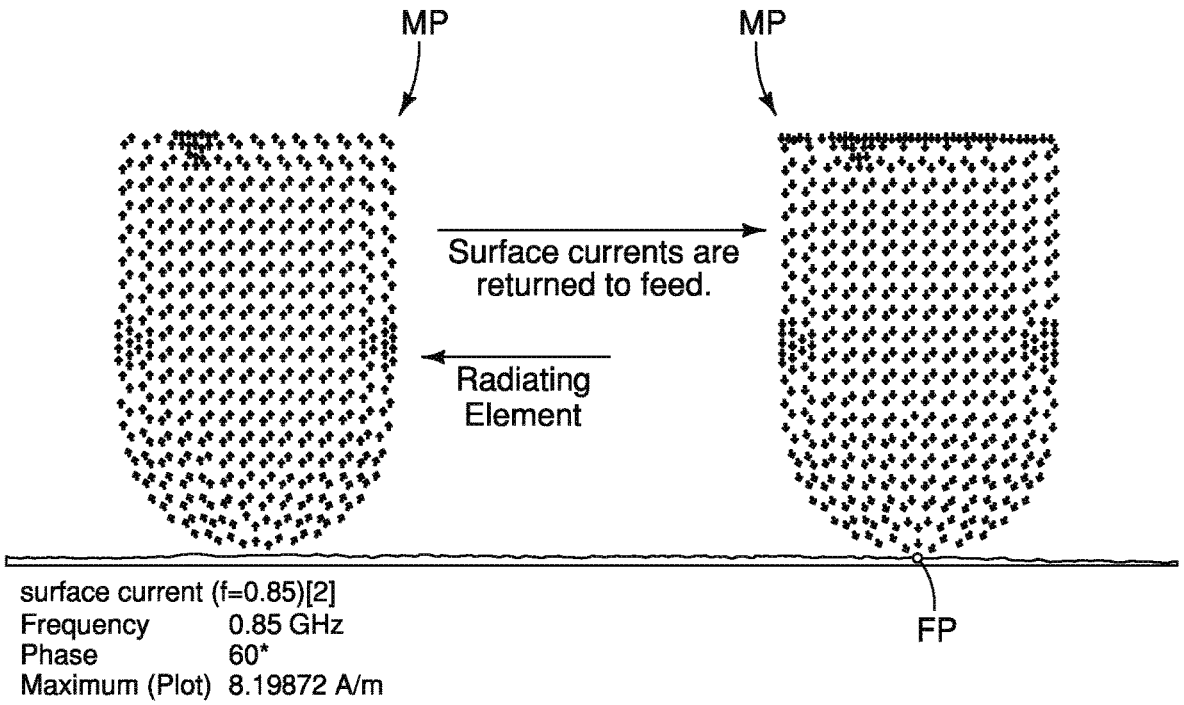
FIG. 34 is a diagram showing surface currents of the two monopole antennas in the comparative configuration shown in FIG. 25.
Figure 35A:
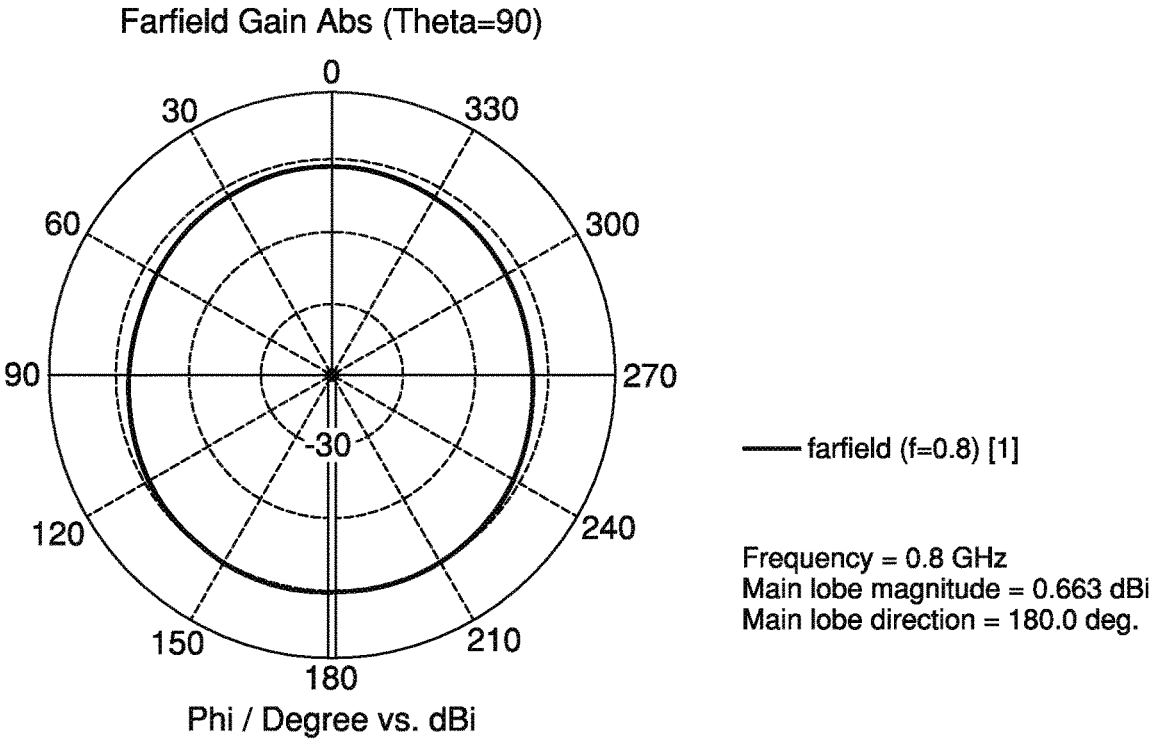
FIGS. 35A and 35B are charts illustrating H-plane cut of radiation patterns of the monopole antennas in the comparative configuration shown in FIG. 25 at the fundamental frequency (if)), respectively.
Figure 35B:
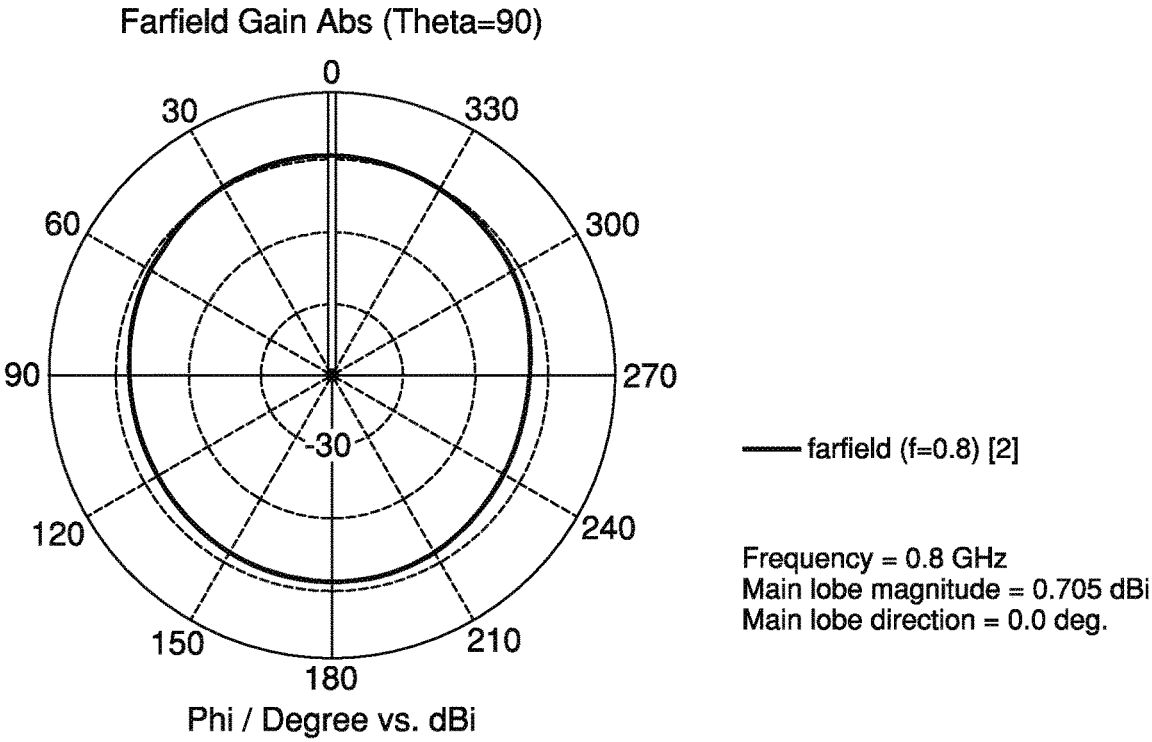

FIG. 34 illustrates surface currents of the two monopole antennas MP in the comparative configuration shown in FIG. 25. In this comparative configuration, the two monopole antennas MP are spaced apart from each other by 54 mm. As seen in FIG. 34, all surface currents from a radiating one of the monopole antennas MP (left side in FIG. 34) are returned to a feed point FP of the other one of the monopole antennas MP (right side in FIG. 34). Furthermore, FIGS. 35A and 35B illustrate H-plane cut of radiation patterns of the monopole antennas MP at the fundamental frequency (f0), respectively.

Figure 36:
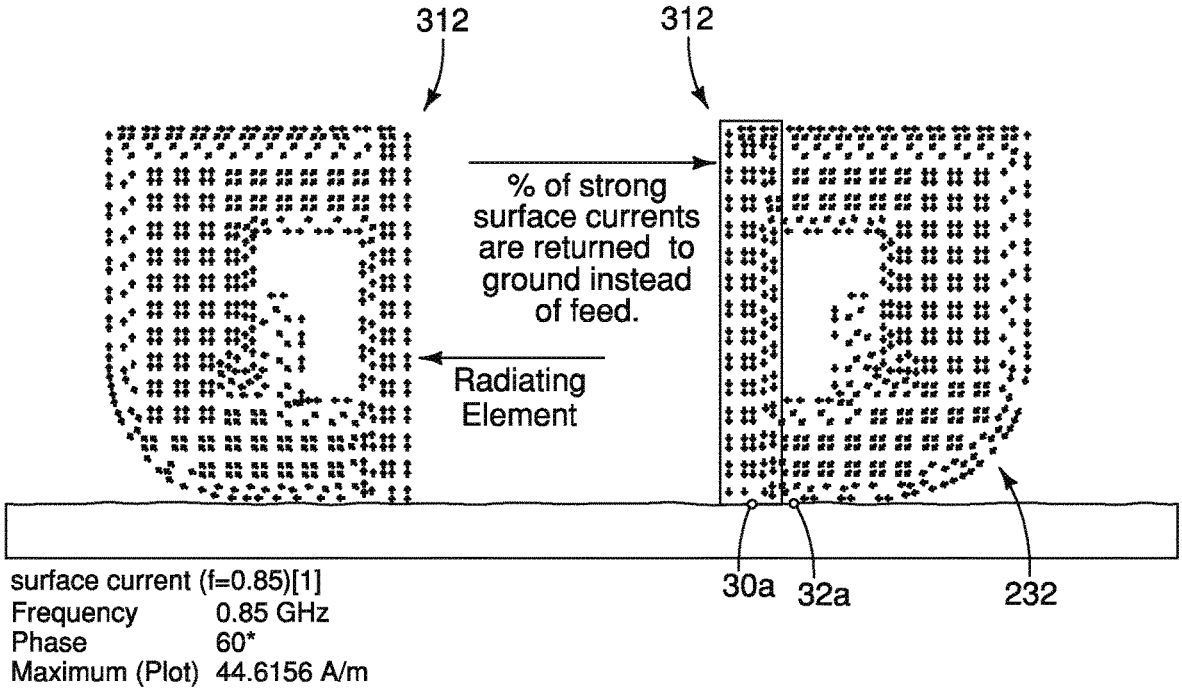
FIG. 36 is a diagram showing surface currents of the half loop antennas in the third configuration shown in FIG. 31.
Figure 37A:
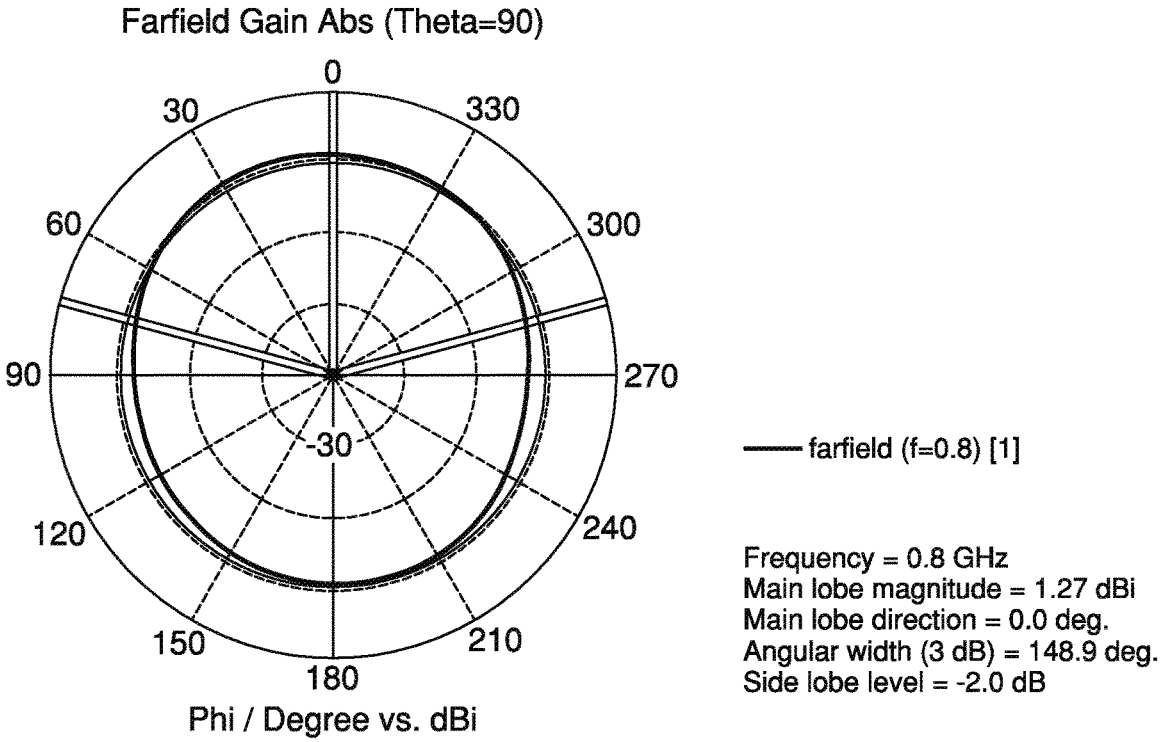
FIGS. 37A and 37B are charts illustrating H-plane cut of radiation patterns of the half loop antennas in the third configuration shown in FIG. 31 at the fundamental frequency (f0), respectively.
Figure 37B:
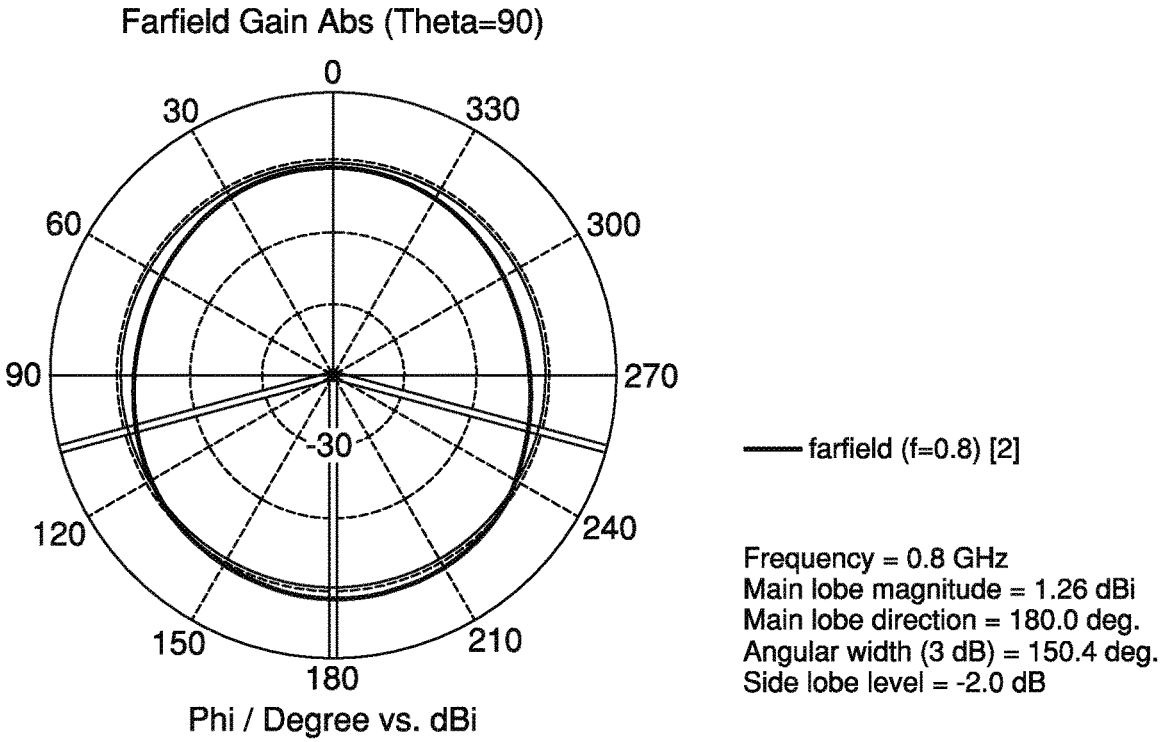

On the other hand, FIG. 36 illustrates surface currents of the half loop antennas 312 in the third configuration shown in FIG. 31. In this third configuration, the half loop antennas 312 are spaced apart from each other by 54 mm. As seen in FIG. 36, a large percentage of the surface currents from a radiating one of the half loop antennas 312 (left side in FIG. 36) are returned to the ground point 30*a* rather than the feed section 232 or the feed point 32*a* of the other one of the half loop antennas 312 (right side in FIG. 36). Furthermore, FIGS. 37A and 37B illustrate H-plane cut of radiation patterns of the half loop antennas 312 in the third configuration at the fundamental frequency (f0), respectively.

For the spatial diversity, it is preferable to keep as much distance between antenna elements as possible for good isolation. In particular, it is preferable to keep at least a distance of one-quarter (¼) wavelength (λ) of the fundamental frequency (f0), such as 600 MHz. However, with the configurations of the present disclosure, in which ground sections of half loop antennas are arranged to face toward each other, isolation between the half loop antennas at the fundamental frequency (f0) can be increased. Thus, the distance between half loop antennas can be reduced to a distance of one-tenth (1/10) to one-eighth (⅛) wavelength (λ) of the fundamental frequency (f0), while maintaining similar or better isolation characteristics relative to one-quarter or further wavelength separated conventional elements. In particular, in the illustrated embodiment, the distance between the half loop antennas, under plastic cover with dielectric constant of three, can be reduced to a distance of 48 mm to 54 mm for the fundamental frequency (f0) of 600 MHz to 617 MHz. Thus, with the configurations of the present disclosure, 2×2 5G MIMO configurations inside the LPA device (i.e., the antenna device 10) for consumer vehicles can be made under 220 mm in length, which can eventually prevent many problems that can happen with antenna devices greater than 220 mm in length, such as water sealing problem and panel warping problem.

Referring now to FIGS. 38 to 50, instead of focusing on explaining the surface current behavior as shown in FIGS. 34 and 36, the increase in the isolation between the two half loop antennas of the present disclosure relative to the comparative configuration shown in FIG. 25 will further be differently explained below.

When two antennas are placed in close proximity to each other, surface currents thereof are shared between the antennas, the ground surfaces and other nearby items. Furthermore, when the antennas are not isolated from each other but are placed in close proximity to each other, the antennas will become an array. The array increases directionality of the antennas to increase the gain toward a direction. Thus, the antennas are usually disposed spaced apart from each other in certain way to create desired effect (one-half (½) wavelength, five-eighth (⅝) wavelength, one (1) wavelength, etc.). If two antennas in close proximity to each other are sufficiently isolated, then the antennas will behave as standalone antennas would. In other words, if two antennas are located close to each other and have high isolation, then the antennas tend toward omnidirectionality as the standalone antenna does. This will further be explained in detail below.

Figure 38:
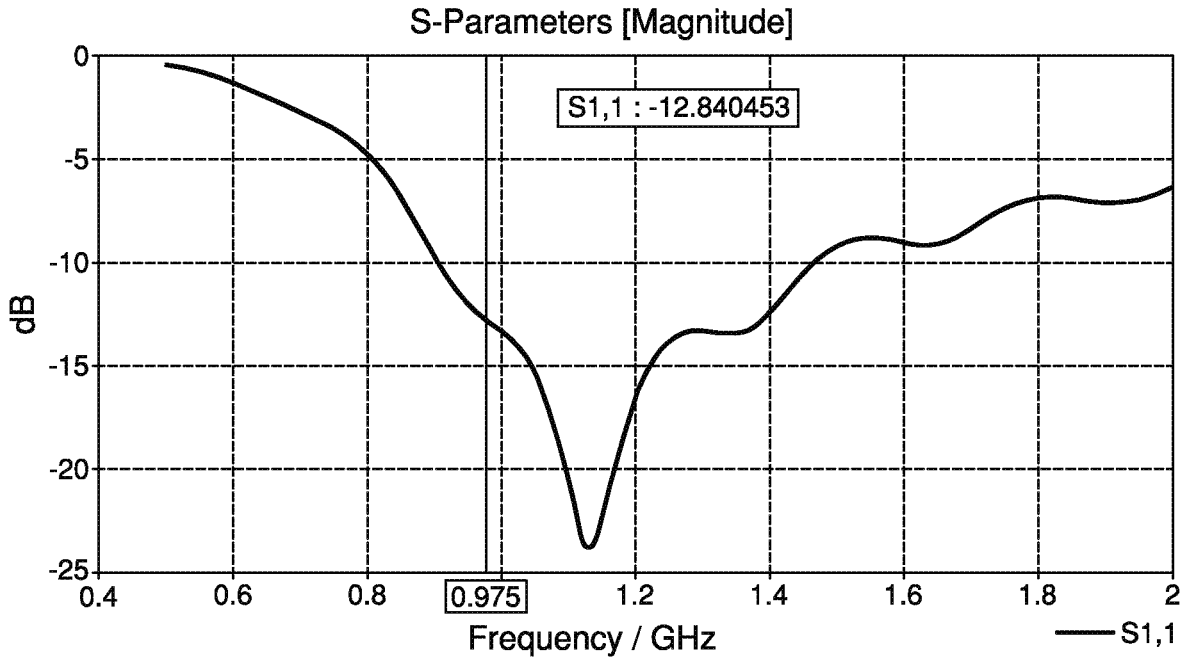
FIG. 38 is a graph showing a return loss of a single monopole antenna in the comparative configuration shown in FIG. 25.

FIG. 38 illustrates a return loss of a single monopole antenna MP in the comparative configuration shown in FIG. 25. As seen in FIG. 38, impedance match of the single monopole antenna MP has been sufficiently achieved. The marker in FIG. 38 shows a region or frequency (f=0.975 GHz) of the lowest isolation (F0: initial lowest frequency) for the comparative configuration, in which the two monopole antennas MP are separated by 48 mm.

Figure 39:
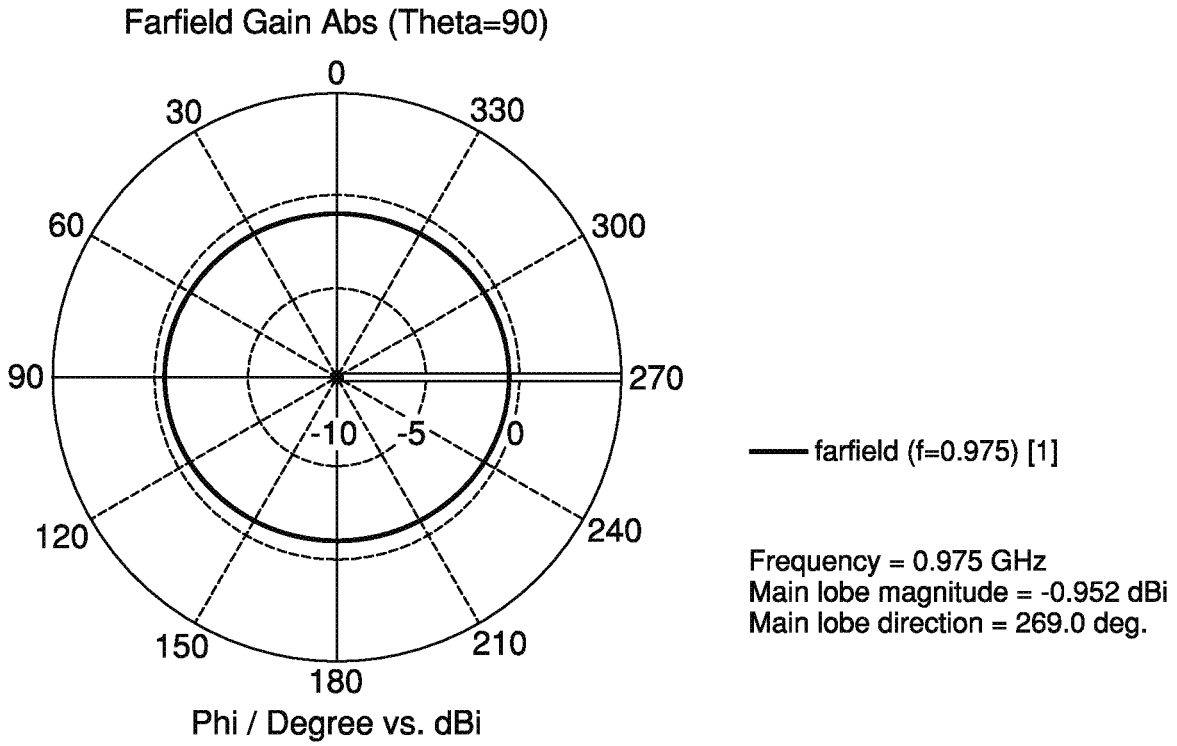
FIG. 39 is a chart illustrating H-plane cut (θ=90 degrees) of the farfield pattern of the single monopole antenna in the comparative configuration shown in FIG. 25 at the initial lowest frequency (F0)

FIG. 39 illustrates H-plane cut (θ=90 degrees) of the farfield pattern of the single monopole antenna MP at the initial lowest frequency (F0). As seen in FIG. 39, the farfield pattern is omnidirectional at specified frequency.

Figure 40:
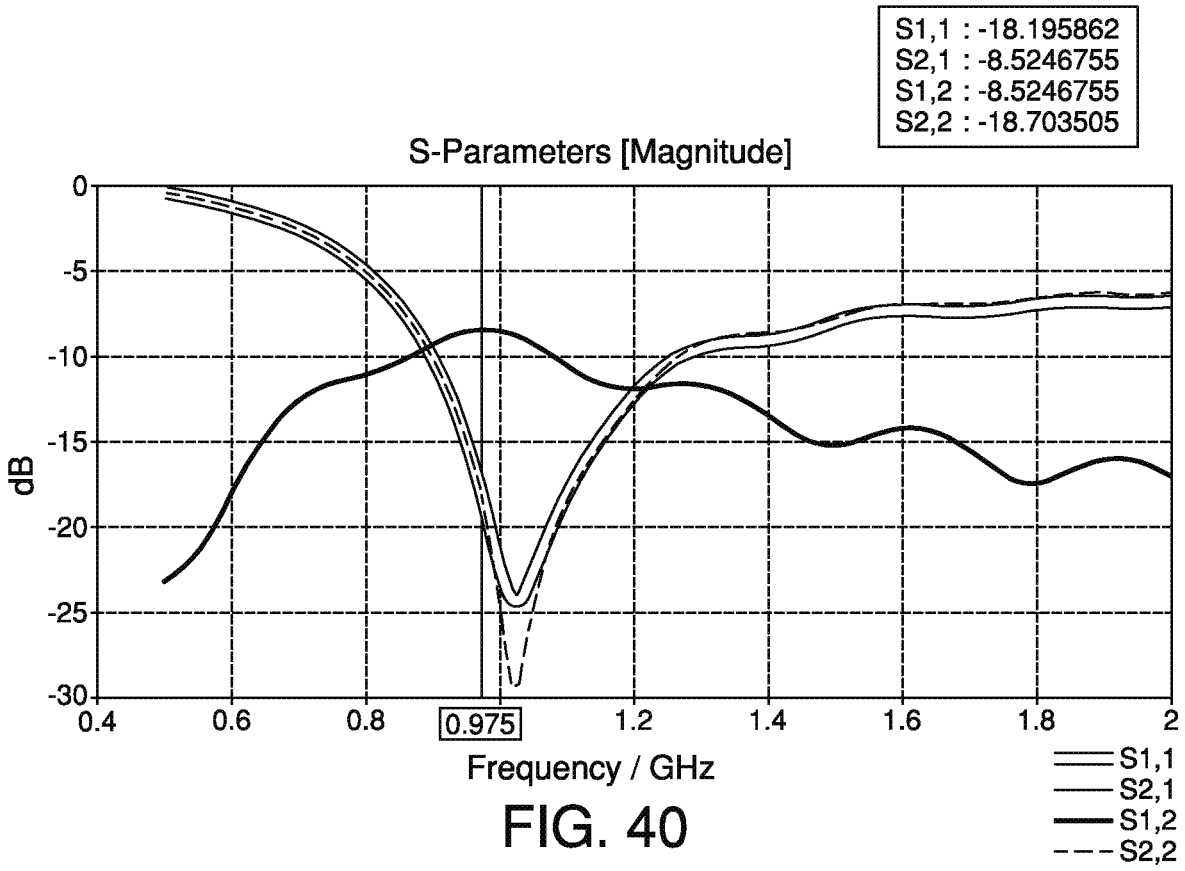
FIG. 40 is a graph showing return losses of both monopole antennas and isolations of the monopole antennas in the comparative configuration shown in FIG. 25.

In the comparative configuration as shown in FIG. 25, the two monopole antennas MP have the same shape and size, and are placed in close proximity to each other by a gap of 48 mm therebetween. FIG. 40 illustrates return losses (S11, S22) of both monopole antennas MP and isolations (S21, S12) of the monopole antennas MP. The marker in FIG. 40 also shows the region or frequency (f=0.975 GHz) of the lowest isolation (F0: initial lowest frequency) for the comparative configuration.

Figure 41A:
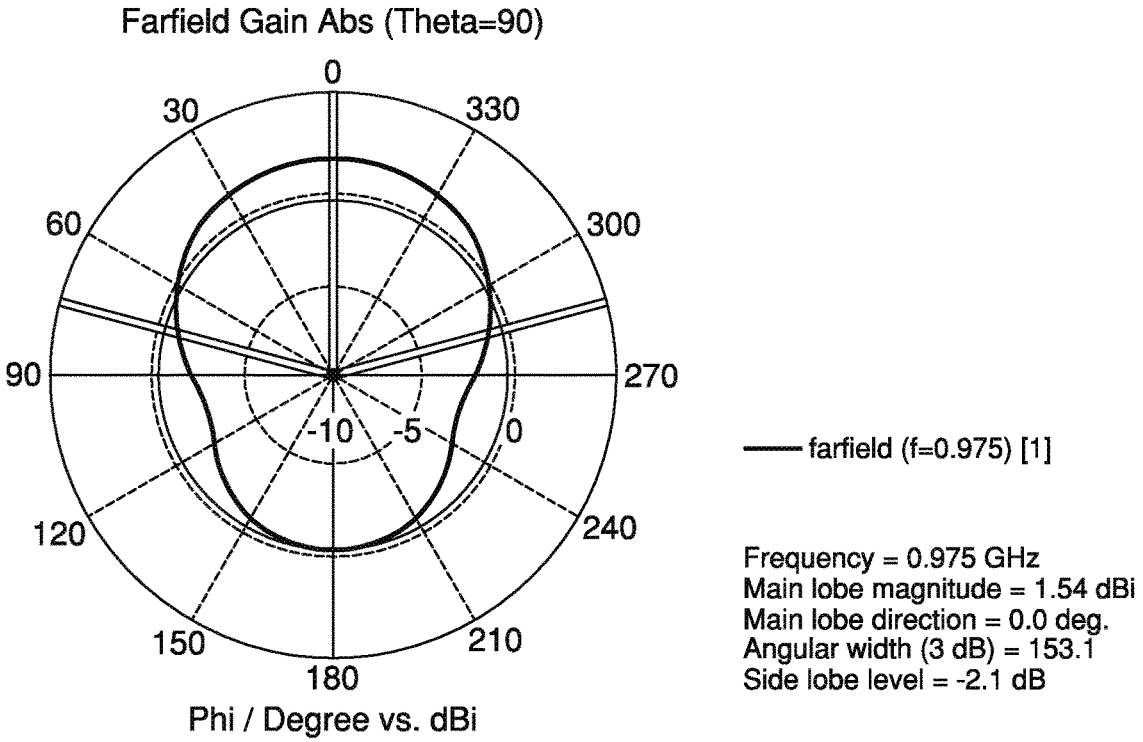
FIGS. 41A and 41B are charts illustrating H-plane cut (θ=90 degrees) of the farfield patterns of the monopole antennas in the comparative configuration shown in FIG. 25 at the initial lowest frequency (F0)
Figure 41B:
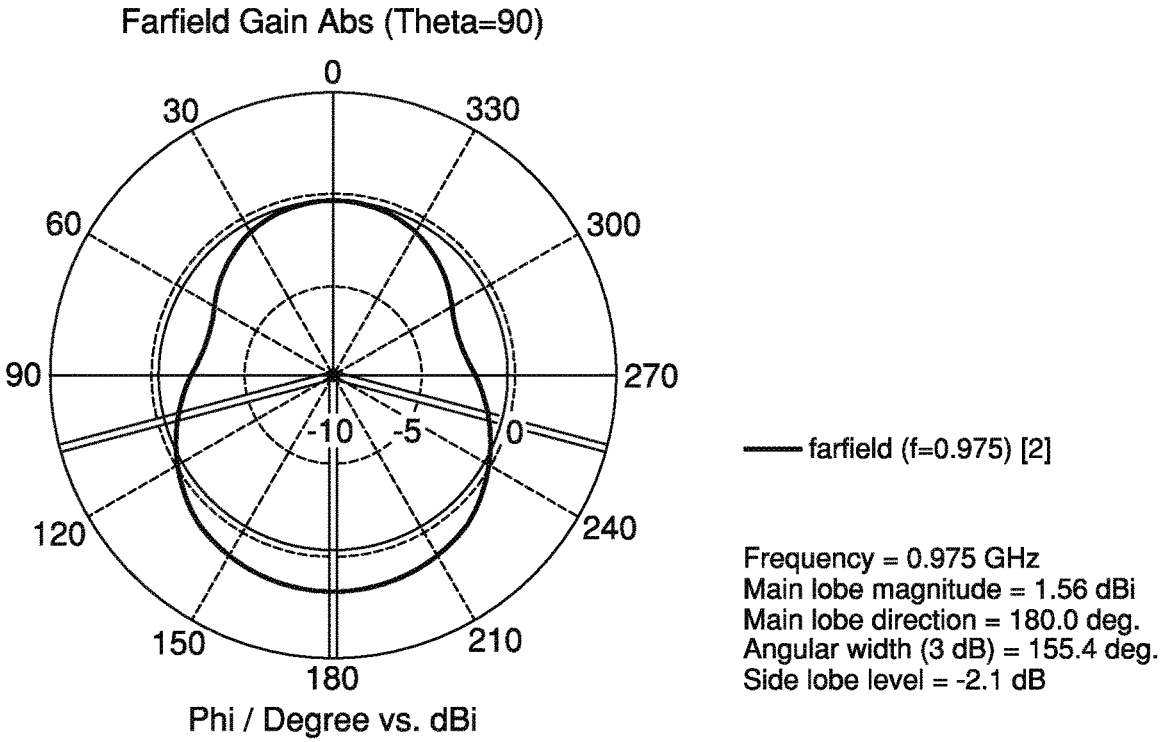

FIGS. 41A and 41B illustrate H-plane cut (0=90 degrees) of the farfield patterns of the monopole antennas MP at the initial lowest frequency (F0). As seen in FIGS. 41A and 41B, the farfield pattern is no longer omnidirectional at the specified frequency and is starting to become directional. This is because of the coupling between the two monopole antennas MP and the coupling of the ground surface between the two monople antennas MP. If both monopole antennas MP are decoupled and well isolated, then the antenna pattern would be same as that of the single monople antenna MP as shown in FIG. 39.

Figure 42:
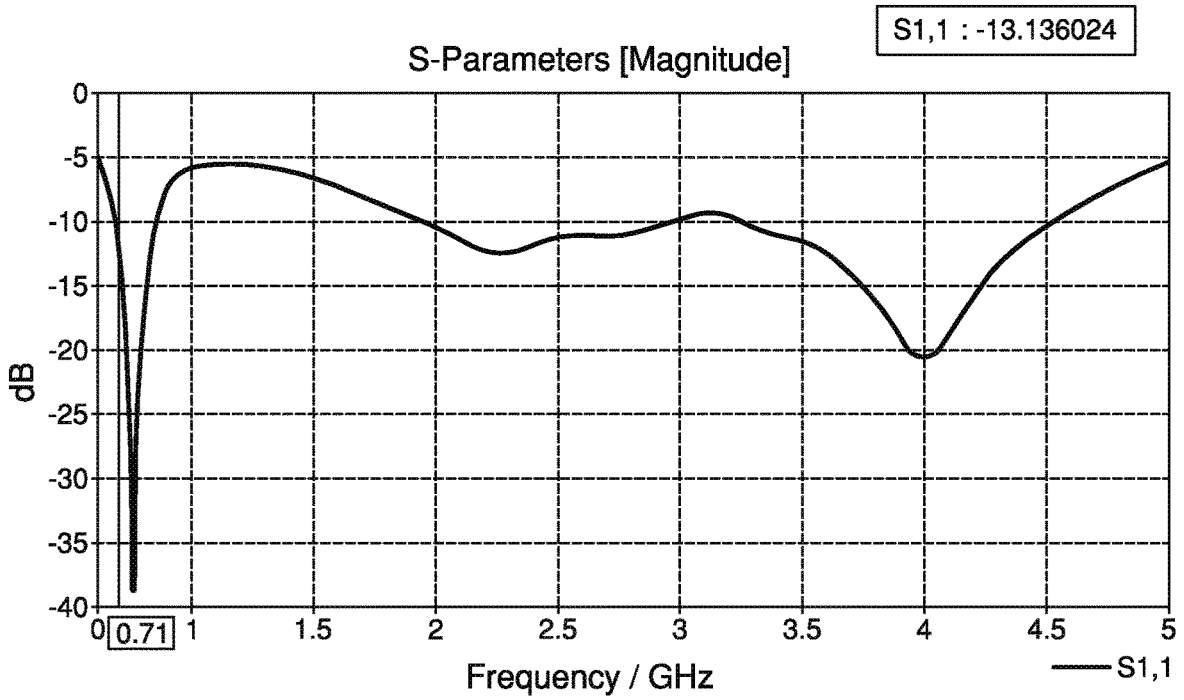
FIG. 42 is a graph showing a return loss of a single half loop antenna, which is one of the half loop antennas shown in FIG. 1.

On the other hand, FIG. 42 illustrates a return loss of the single half loop antenna 14 as shown in FIGS. 1 to 3. As seen in FIG. 42, impedance match of the single half loop antenna 14 has been sufficiently achieved. The marker in FIG. 42 shows a region or frequency (f=0.71 GHz) of the lowest isolation (F0: initial lowest frequency) for a configuration, in which two half loop antennas 14 are separated by 48 mm.

Figure 43:
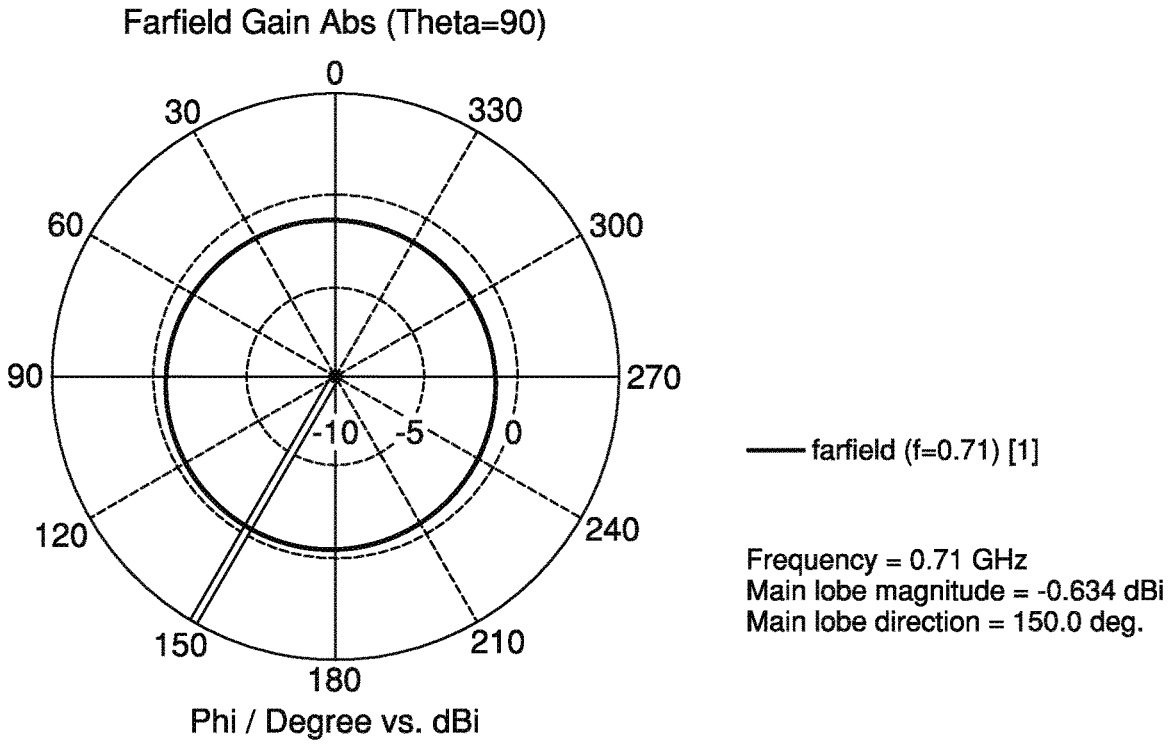
FIG. 43 is a chart illustrating H-plane cut (θ=90 degrees) of the farfield pattern of the single half loop antenna, which is one of the half loop antennas shown in FIG. 1, at the initial lowest frequency (F0)

FIG. 43 illustrates H-plane cut (θ=90 degrees) of the farfield pattern of the single half loop antenna 14 at the initial lowest frequency (F0). As seen in FIG. 43, the farfield pattern is omnidirectional at specified frequency.

Figure 44:
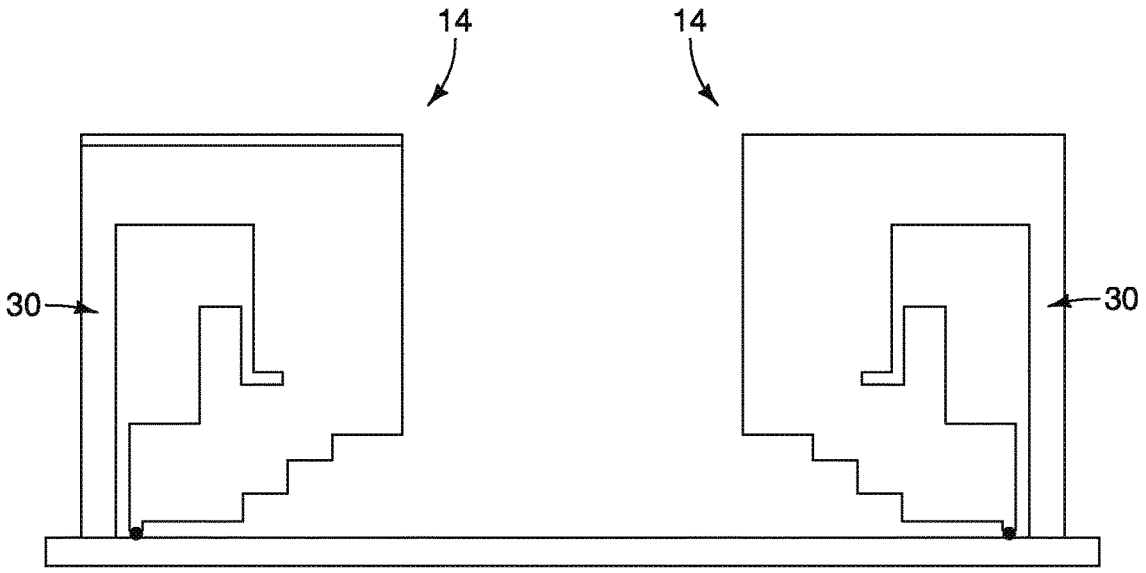
FIG. 44 is an elevational view of a fourth configuration in which two half loop antennas, which are the same one of the half loop antennas shown in FIG. 1, are arranged relative to each other with ground sections thereof facing away from each other.

FIG. 44 illustrates a fourth configuration in which two half loop antennas 14 are placed in close proximity to each other by a gap of 48 mm therebetween. In this fourth configuration, the half loop antennas 14 are arranged relative to each other such that the ground sections 30 face away from each other.

Figure 45:
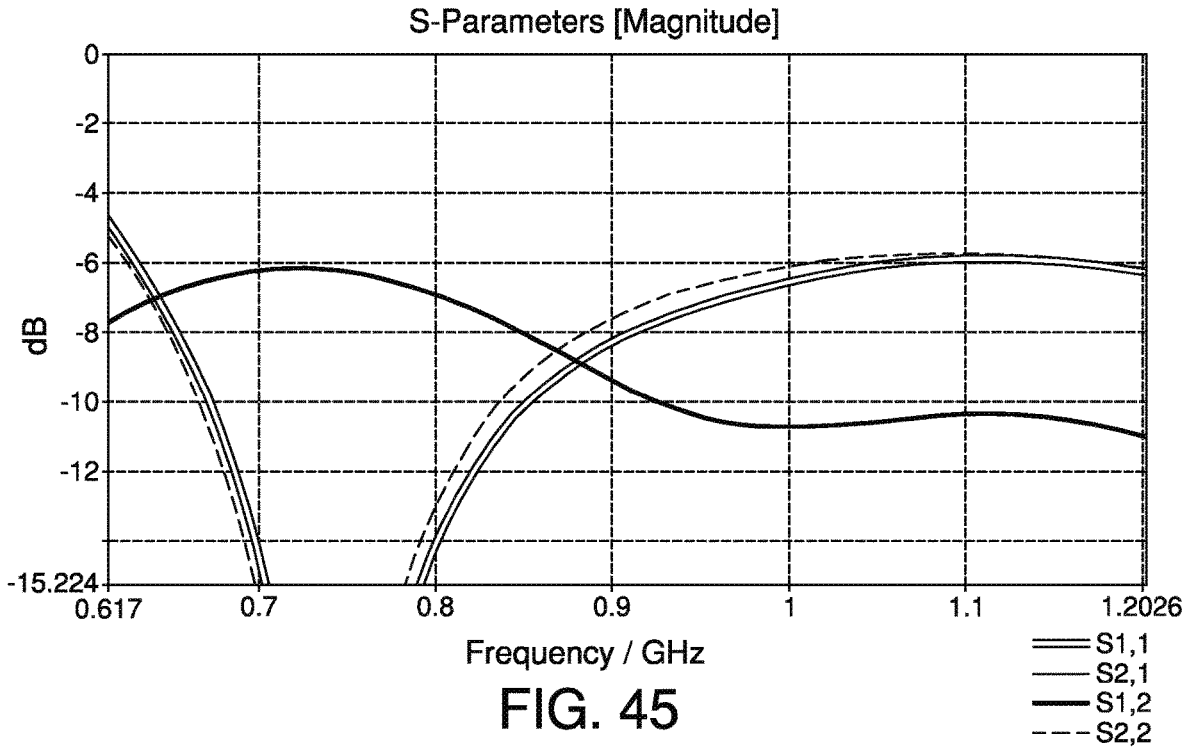
FIG. 45 is a graph showing return losses of both half loop antennas and isolations of the half loop antennas in the fourth configuration as shown in FIG. 44.

FIG. 45 illustrates return losses (S11, S22) of both half loop antennas 14 and isolations (S21, S12) of the half loop antennas 14 in the fourth configuration as shown in FIG. 44. Specifically, in the fourth configuration as shown in FIG. 44, the isolation (S21, S12) between the half loop antennas 14 is about −6 dB at 0.71 GHz, which is the region or frequency of the lowest isolation (F0: initial lowest frequency) for the fourth configuration as shown in FIG. 44.

Figure 46A:
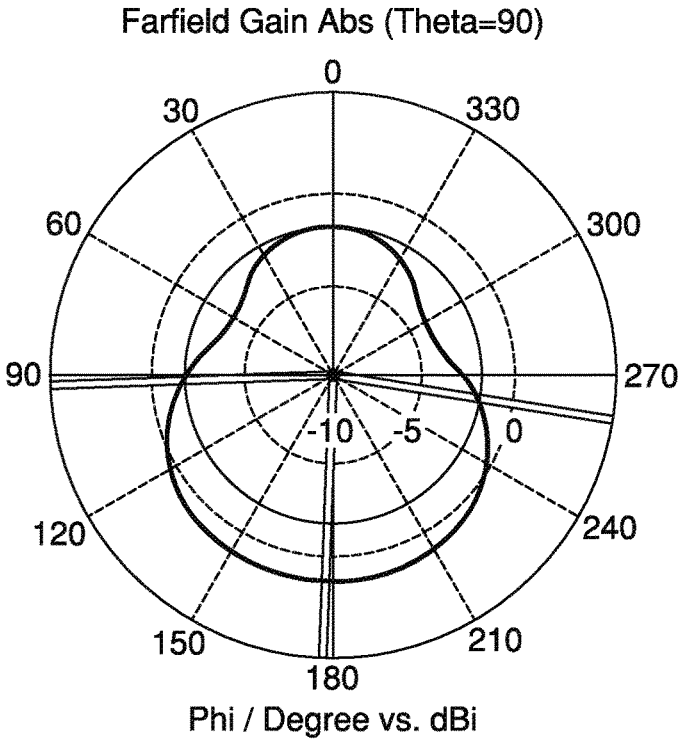
FIGS. 46A and 46B are charts illustrating H-plane cut (θ=90 degrees) of the farfield patterns of the half loop antennas in the fourth configuration shown in FIG. 44 at the initial lowest frequency (F0)
Figure 46B:
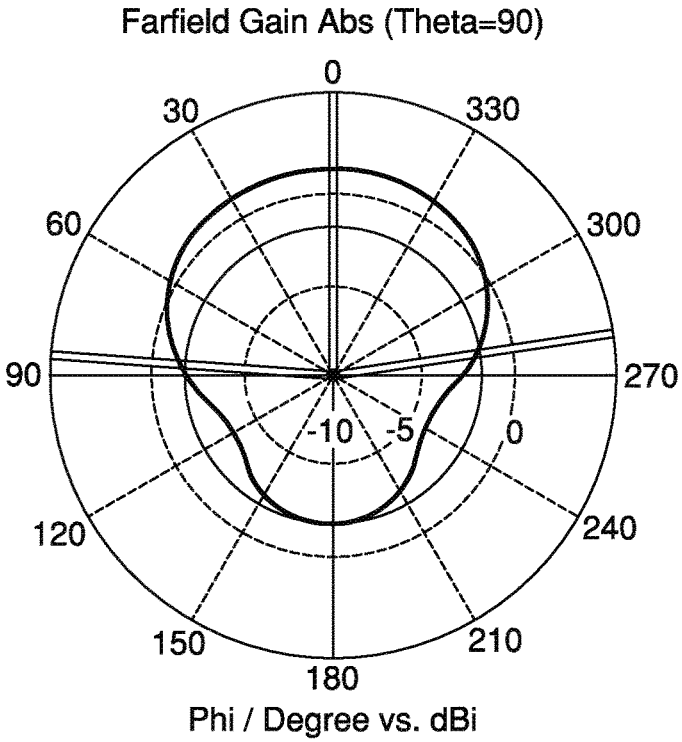

FIGS. 46A and 46B illustrate H-plane cut (θ=90 degrees) of the farfield patterns of the half loop antennas 14 at the initial lowest frequency (F0). As seen in FIGS. 46A and 46B, the farfield pattern is no longer omnidirectional at the specified frequency and is starting to become directional. This is because of the coupling between the two half loop antennas 14 and the coupling of the ground surface between the two half loop antennas 14. If both half loop antennas 14 are decoupled and well isolated, then the antenna pattern would be same as that of the single half loop antenna 14 as shown in FIG. 43.

Figure 47:
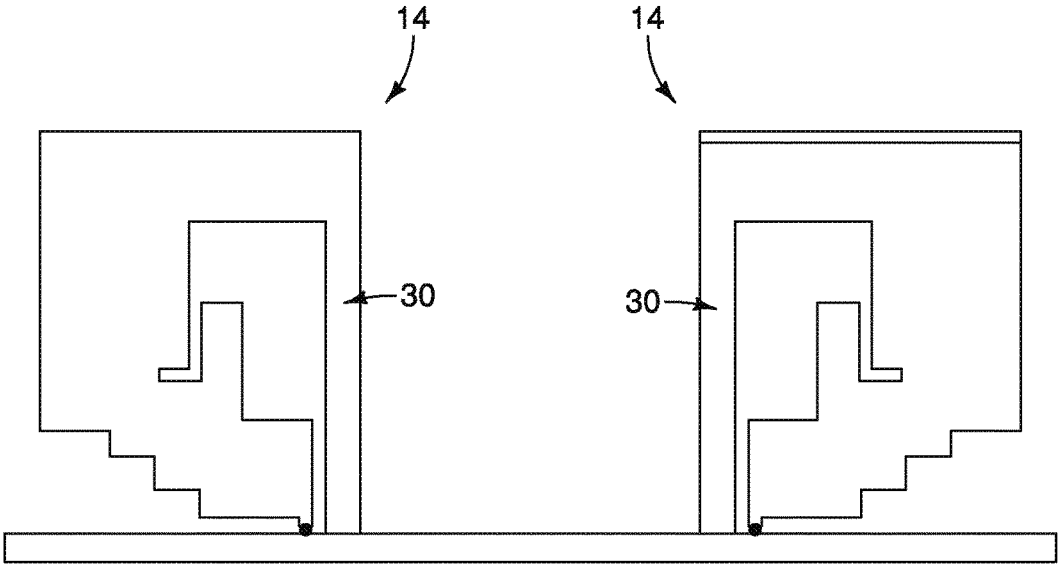
FIG. 47 is an elevational view of a fifth configuration in which two half loop antennas, which are the same one of the half loop antennas shown in FIG. 1, are arranged relative to each other with the ground sections thereof facing toward each other.

FIG. 47 illustrates a fifth configuration in which two half loop antennas 14 are placed in close proximity to each other by a gap of 48 mm therebetween. In this fifth configuration, the half loop antennas 14 are arranged relative to each other such that the ground sections 30 face toward each other. As mentioned above, this arrangement of the ground sections 39 can well isolate the half loop antennas 14 with each other and increase the isolation.

Figure 48:
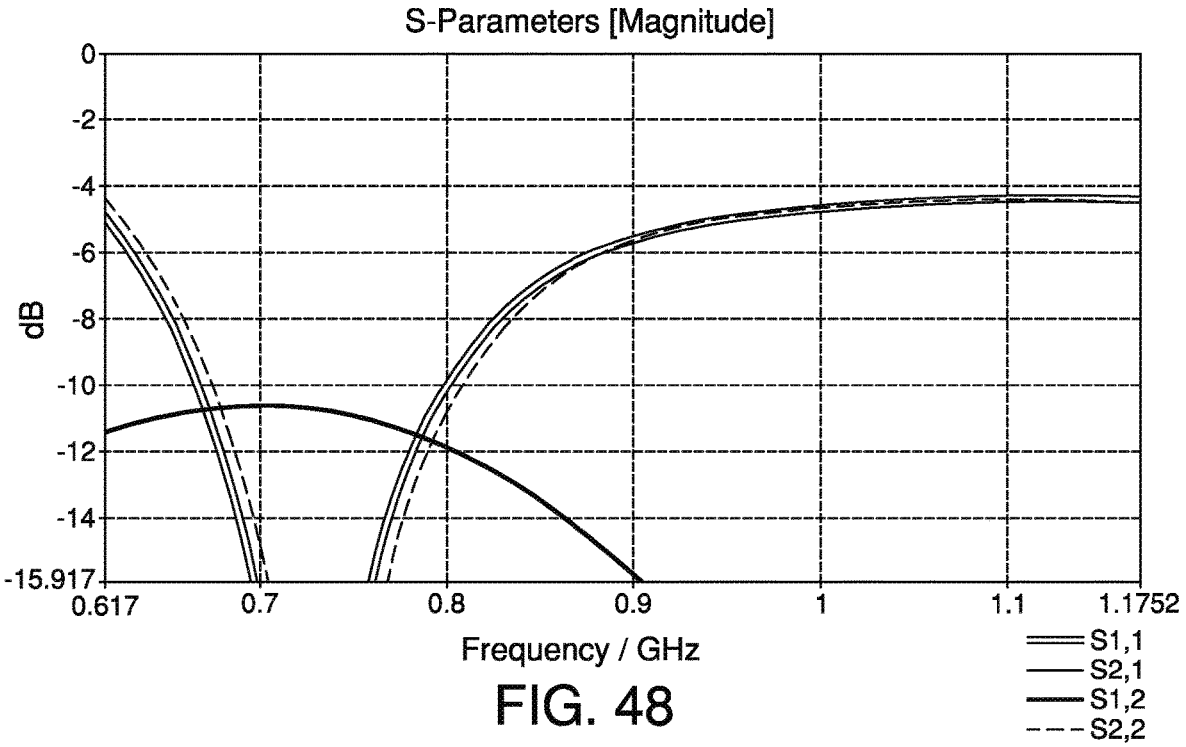
FIG. 48 is a graph showing return losses of both half loop antennas and isolations of the half loop antennas in the fifth configuration as shown in FIG. 47.

FIG. 48 illustrates return losses (S11, S22) of both half loop antennas 14 and isolations (S21, S12) of the half loop antennas 14 in the fifth configuration as shown in FIG. 47. Specifically, in the fifth configuration as shown in FIG. 47, the isolation (S21, S12) between the half loop antennas 14 is about −11 dB at 0.71 GHz, which is the region or frequency of the lowest isolation (F0: initial lowest frequency) for the fifth configuration as shown in FIG. 47.

Figure 49:
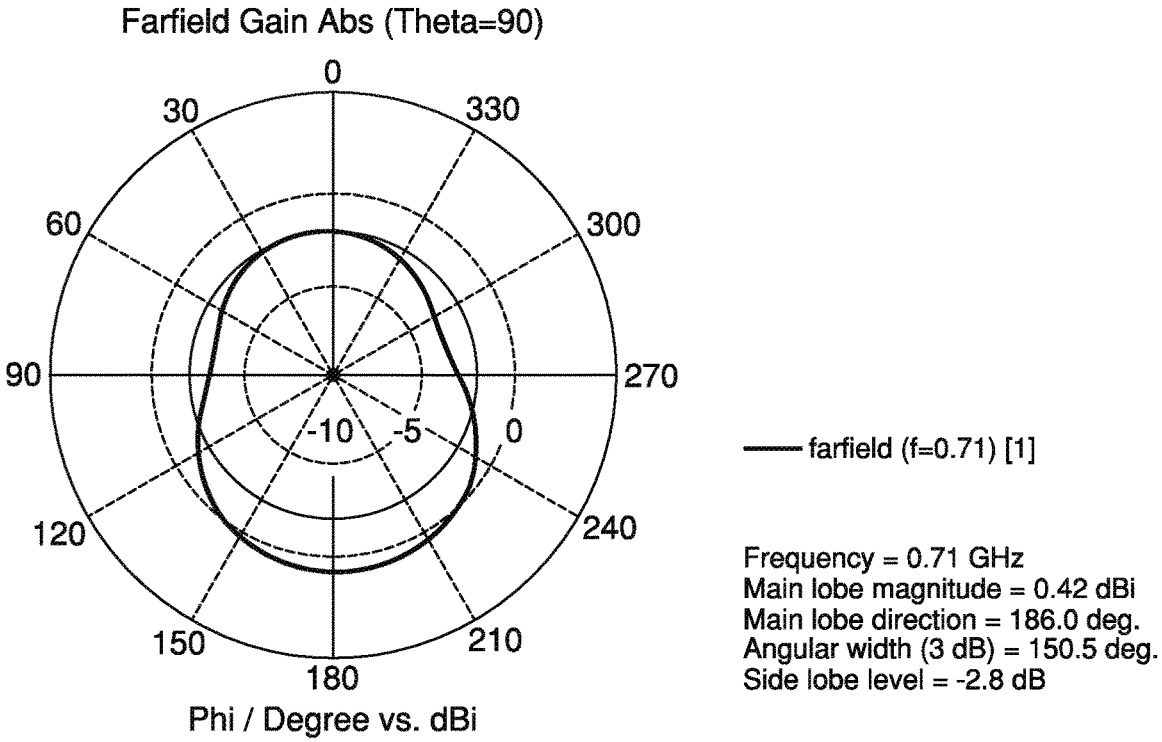
FIG. 49 is a chart illustrating H-plane cut (θ=90 degrees) of the farfield pattern of one of the half loop antennas in the fifth configuration shown in FIG. 47 at the initial lowest frequency (F0)

FIG. 49 illustrates H-plane cut (θ=90 degrees) of the farfield pattern of one of the half loop antennas 14 at the initial lowest frequency (F0). The farfield pattern of the other one of the half loop antennas 14 at the initial lowest frequency (F0) can be the same but mirrored. As seen in FIG. 49, the farfield pattern is changing toward omnidirectional at the specified frequency and the directionality is decreased. This is because the half loop antennas 14 in the fifth configuration as shown in FIG. 47 are better isolated from each other and the currents coupling between the half loop antennas 14 and around the ground surface surrounding the half loop antennas 14 are reduced. As mentioned above, if both half loop antennas 14 are decoupled and well isolated, then the antenna pattern would be same as that of the single half loop antenna 14 as shown in FIG. 43.

Figure 50:
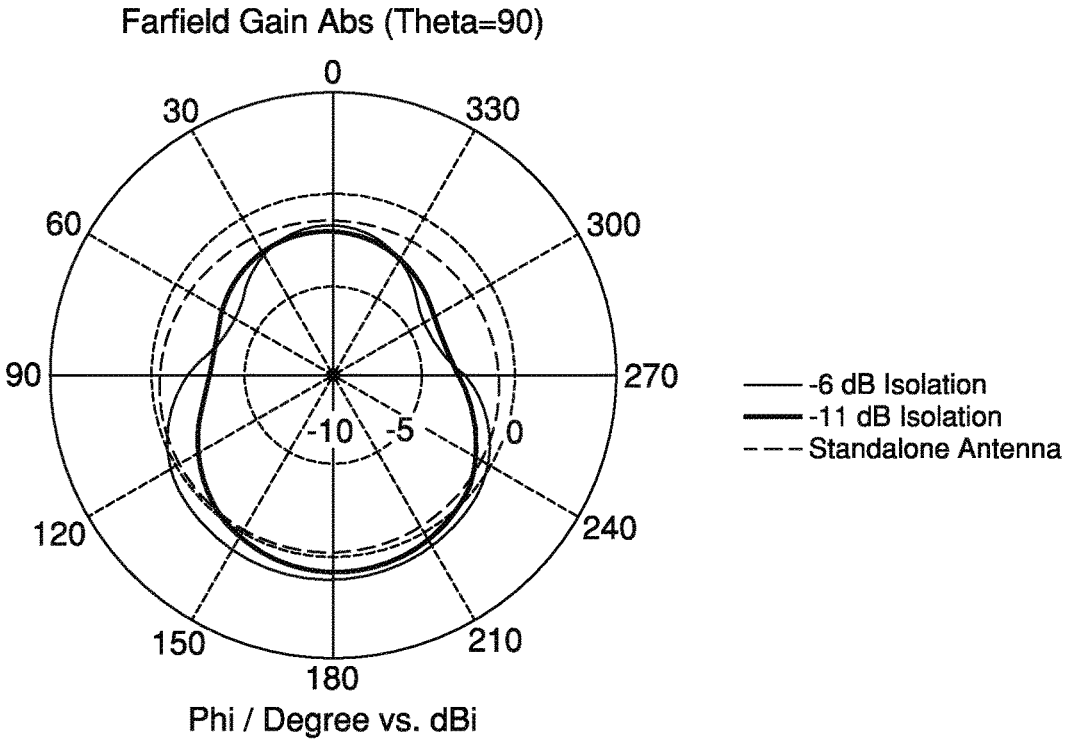
FIG. 50 is a chart illustrating H-plane cut (θ=90 degrees) of the farfield pattern of the single half loop antenna shown in FIG. 43, the farfield pattern of one of the half loop antennas in the fourth configuration shown in FIG. 46A and the farfield pattern of one of the half loop antenna in the fifth configuration shown in FIG. 49.

FIG. 50 illustrates H-plane cut (θ=90 degrees) of the farfield pattern of the single half loop antenna 14 as shown in FIG. 43 ("Standalone Antenna"), the farfield pattern of one of the half loop antennas 14 in the fourth configuration as shown in FIG. 46A ("−6 dB Isolation") and the farfield pattern of one of the half loop antenna 14 in the fifth configuration as shown in FIG. 49 ("−11 dB Isolation"). As seen in FIG. 50, as the isolation between the antennas improving, the directionality tends to be back toward omnidirectionality of the standalon antenna. On the other hand, as the isolation being reduced, the directionality of the antennas increases since the two antennas in close proximity to each other start to become an array.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "below", "upward", "downward", "top", "bottom", "side", "vertical", "horizontal", "perpendicular" and "transverse" as well as any other similar directional terms refer to those directions of a vehicular antenna device in an upright position on a horizontal surface and equipped with a vehicular half loop antenna. Accordingly, these directional terms, as utilized to describe the vehicular half loop antenna should be interpreted relative to a vehicular antenna device in an upright position on a horizontal surface. The terms "left" and "right" are used to indicate the "right" when referencing from the right side as viewed from the rear of the vehicular antenna device, and the "left" when referencing from the left side as viewed from the rear of the vehicular antenna device.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined". "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents

What is claimed is:

1. A vehicular half loop antenna comprising:

a ground section having a ground point that is configured to be electrically grounded; and a feed section configured to be electrically connected to the ground section, the feed section including a first feed portion having a feed point that is configured to be electrically connected to an antenna feed, and a second feed portion connected to the first feed portion via a corner portion therebetween, with the corner portion being located farther from the ground point than the feed point and having a curved or tapered outer edge.

2. The vehicular half loop antenna according to claim 1, wherein the feed section further includes an extension part that faces opposite an inner edge of the first feed portion or an inner edge of the second feed portion with a slot therebetween.

3. The vehicular half loop antenna according to claim 2, wherein the slot has an L-shape.

4. The vehicular half loop antenna according to claim 2, wherein the first feed portion has a first end and a second end that is opposite the first end and is connected to the corner portion, and the extension part extends from the inner edge of the first feed portion at a location spaced apart from the first end of the first feed portion.

5. The vehicular half loop antenna according to claim 1, wherein the first feed portion has a first end and a second end that is opposite the first end and is connected to the corner portion, and the feed point is disposed on an outer edge of the first feed portion at a location closer to the first end of the first feed portion than the second end of the first feed portion.

6. The vehicular half loop antenna according to claim 5, wherein the feed point is disposed on the outer edge of the first feed portion at the first end of the first feed portion.

7. The vehicular half loop antenna according to claim 1, wherein the second feed portion of the feed section is spaced apart from the ground section in a first direction of the vehicular half loop antenna, and the second feed portion of the feed section has a width in the first direction that is larger than that of the ground section in the first direction.

8. The vehicular half loop antenna according to claim 1, further comprising an intermediate section connected between the ground section and the second feed portion of the feed section.

9. The vehicular half loop antenna according to claim 8, wherein the intermediate section including a base portion that is connected between the ground section and the second feed portion of the feed section and a bent portion that is bent relative to the base portion.

10. The vehicular half loop antenna according to claim 9, wherein the bent portion includes a first bent part that is bent along a first edge of the base portion and a second bent part that is bent along a second edge of the base portion, the first edge and the second edge extending in different directions.

11. The vehicular half loop antenna according to claim 8, wherein the ground section, the feed section and the intermediate section are integrated as a one-piece, unitary member.

12. The vehicular half loop antenna according to claim 11, wherein the ground section, the feed section and the intermediate section are made of metal plate.

13. The vehicular half loop antenna according to claim 8, wherein the ground section, the feed section and the intermediate section are dimensioned to define an electrical path that extends between the ground point and the feed point and has a length corresponding to a half-wavelength at a frequency between 0.6 GHz to 6 GHz.

14. A vehicular antenna device comprising:

an antenna base configured to be attached to a vehicle body of a vehicle; and a pair of half loop antennas disposed on the antenna base at locations spaced apart from each other in a first direction of the antenna base, the half loop antennas each including a ground section having a ground point that is configured to be electrically grounded, and a feed section configured to be electrically connected to the ground section, the feed section including a first feed portion having a feed point that is configured to be electrically connected to an antenna feed, and a second feed portion connected to the first feed portion via a corner portion therebetween, with the corner portion being located farther from the ground point than the feed point.

15. The vehicular antenna device according to claim 14, wherein the half loop antennas are arranged relative to each other such that the ground sections of the half loop antennas face toward each other and the feed sections of the half loop antennas face away from each other.

16. The vehicular antenna device according to claim 15, wherein the half loop antennas are arranged relative to each other such that the ground sections of the half loop antennas are disposed between the feed sections of the half loop antennas in the first direction of the antenna base.

17. The vehicular antenna device according to claim 14, wherein the half loop antennas are arranged relative to the antenna base such that the ground point and the feed point of each of the half loop antennas are aligned relative to each other along the first direction of the antenna base.

18. The vehicular antenna device according to claim 14, further comprising an additional antenna disposed on the antenna base between the half loop antennas in the first direction of the antenna base.

19. The vehicular antenna device according to claim 14, wherein the antenna base is configured to be attached to the vehicle body of the vehicle such that the first direction of the antenna base is aligned with a longitudinal axis of the vehicle body of the vehicle.

20. The vehicular antenna device according to claim 14, further comprising an antenna housing attached to the antenna base to house the half loop antennas within an interior space defined between the antenna base and the antenna housing.

* * * * *